US010682582B2

(12) United States Patent
Simonds et al.

(10) Patent No.: US 10,682,582 B2
(45) Date of Patent: Jun. 16, 2020

(54) CONSTRUCTIONAL TOY

(71) Applicant: CHISWICK INNOVATIONS LIMITED, London (GB)

(72) Inventors: Colin Duncan Simonds, London (GB); James Campbell Duncan Simonds, London (GB)

(73) Assignee: CHISWICK INNOVATIONS LIMITED, London (GB)

( * ) Notice: Subject to any disclaimer, the term of this patent is extended or adjusted under 35 U.S.C. 154(b) by 0 days.

(21) Appl. No.: 16/094,497

(22) PCT Filed: Mar. 10, 2017

(86) PCT No.: PCT/GB2017/050668

§ 371 (c)(1),
(2) Date: Oct. 18, 2018

(87) PCT Pub. No.: WO2017/182767

PCT Pub. Date: Oct. 26, 2017

(65) Prior Publication Data

US 2019/0118109 A1 Apr. 25, 2019

(30) Foreign Application Priority Data

Apr. 18, 2016 (GB) ..... 1606722.5

(51) Int. Cl.
*A63H 33/08* (2006.01)
*A63H 33/10* (2006.01)

(52) U.S. Cl.
CPC ..... *A63H 33/086* (2013.01); *A63H 33/107* (2013.01); *A63H 33/108* (2013.01)

(58) Field of Classification Search
CPC ... A63H 33/086; A63H 33/107; A63H 33/108
USPC ..... 446/117, 118, 124, 125, 128
See application file for complete search history.

(56) References Cited

U.S. PATENT DOCUMENTS

D285,813 S * 9/1986 Takahashi ..... D21/501
D313,437 S * 1/1991 Andersen ..... D21/495
D324,084 S * 2/1992 Knudsen ..... D21/500
5,788,555 A * 8/1998 Glynn ..... A63H 33/10 446/124
5,918,497 A 8/1999 Mott
(Continued)

FOREIGN PATENT DOCUMENTS

CN 104190092 A 12/2014
CN 208018155 U * 10/2018
JP S54-169597 U 11/1979

OTHER PUBLICATIONS

International Search Report, dated May 19, 2017 (3 pages).
Written Opinion, dated Jan. 2015 (8 pages).

*Primary Examiner* — Vishu K Mendiratta
(74) *Attorney, Agent, or Firm* — Jacobson Holman, PLLC

(57) ABSTRACT

A constructional toy comprising a plurality of elements which can be assembled together to form a variety of three dimensional structures. The elements include a triangular prism shaped brick element comprising a plurality of walls. The walls define a male mating side having a male engagement feature which extends from the brick. The walls also define a female mating side which defines a cavity configured for receiving an engagement feature of the same configuration as provided on the male mating side.

15 Claims, 26 Drawing Sheets

(56) References Cited

U.S. PATENT DOCUMENTS

| | | | | |
|---|---|---|---|---|
| 6,554,676 | B1 * | 4/2003 | Bach | A63H 33/086 446/116 |
| 6,648,715 | B2 * | 11/2003 | Wiens | A63H 33/062 446/121 |
| 6,679,780 | B1 * | 1/2004 | Shih | A63F 9/1204 273/156 |
| 7,063,587 | B1 * | 6/2006 | Lin | A63H 33/086 273/156 |
| D545,923 | S * | 7/2007 | Lin | D21/505 |
| D573,203 | S * | 7/2008 | Chun | D21/505 |
| D734,820 | S * | 7/2015 | Lee | D21/484 |
| 9,737,826 | B2 * | 8/2017 | Cheng | A63H 33/086 |
| 2006/0025035 | A1 * | 2/2006 | Glickman | A63H 33/102 446/124 |
| 2006/0185308 | A1 * | 8/2006 | Lin | E04B 2/12 52/596 |
| 2014/0227937 | A1 * | 8/2014 | Pai-Chen | A63H 33/086 446/122 |

* cited by examiner

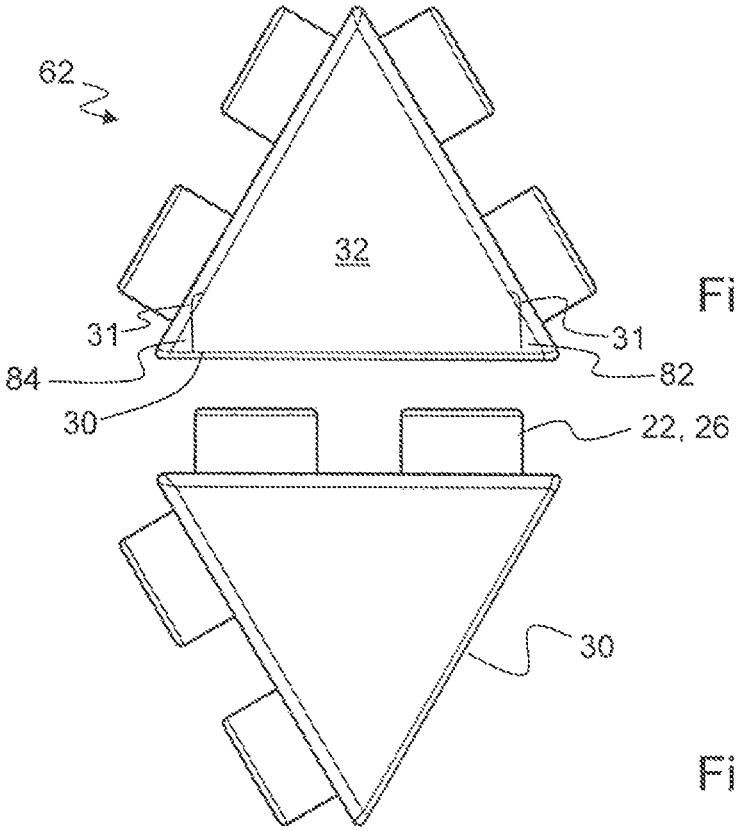
Figure 15a
Figure 15b
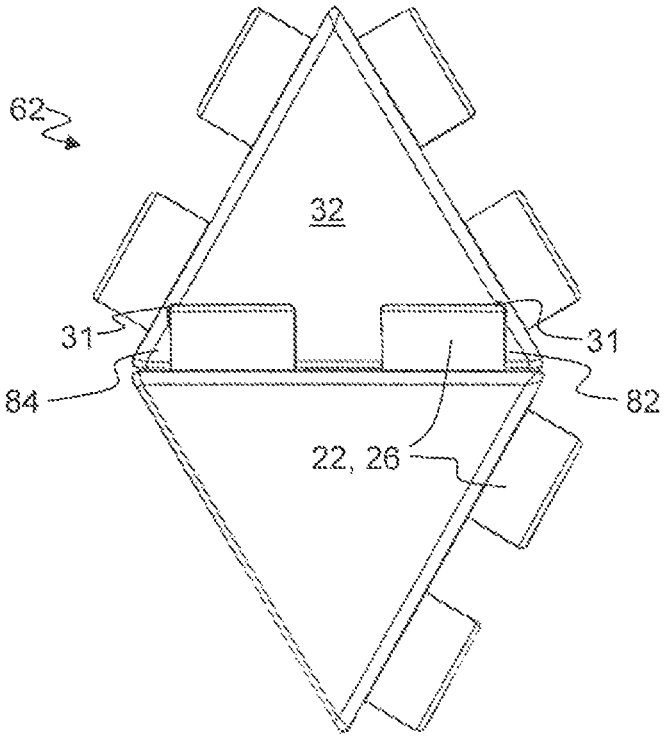
Figure 15c

CONSTRUCTIONAL TOY

The present disclosure relates to a constructional toy.

BACKGROUND

There are many commonly available constructional toys for children. They range in complexity to meet the developmental needs and abilities of children, whether for recreation or education. As well as promoting co-ordination skills, they help to encourage creativity and develop an understanding of basic mechanics.

Constructional toys for younger children tend to be simplistic, allowing for constructional elements to be joined end to end (i.e. uni-directional). Constructional toys for older children allow for more complex structures (for example, extending in multiple directions), but are inappropriate for younger children as they require dexterity and understanding beyond the ability of a younger child.

Young children may quickly exhaust the possibilities of the simpler constructional toys, but may be frustrated by the complexity of more advanced constructional systems. Thus a child may lose interest in such play, and hence lose an appreciation of engineering subjects as a whole.

Hence a constructional toy which may be used by children of different developmental stages, which provides a medium for creativity, enables continued development of their mechanical skills and understanding, is highly desirable.

SUMMARY

According to the present disclosure there is provided apparatus as set forth in the appended claims. Other features of the invention will be apparent from the dependent claims, and the description which follows.

Accordingly there may be provided a constructional toy comprising a plurality of elements which can be assembled together to form a variety of three dimensional structures, said elements including: a triangular prism shaped brick element comprising a plurality of walls which define: two square sides angled relative to one another, at least one of which is provided as a male mating side having a male engagement feature which extends from the brick; and a cavity which provides a female mating side, the cavity defined by the plurality of walls, at least one of the square sides having an indented region on its inner surface; the cavity having a square perimeter defined by an edge of each wall, wherein the cavity is configured for receiving an engagement feature of the same configuration as provided on the male mating side, and the indented region is positioned and configured to receive a portion of the engagement feature, to thereby link elements of the constructional toy together.

There may also be provided a cuboid brick element comprising a plurality of walls which define male and female mating sides, and a cavity which provides the female mating side, the cavity defined by the plurality of walls, the male and female mating sides of the cuboid brick having engagement features complementary in shape to the female and male engagement features respectively of the triangular prism shaped brick element.

The cuboid brick element may be cubic and its plurality of walls define: male and female mating sides having edges of the same length as the mating sides of the triangular prism shaped brick.

The triangular prism shaped brick may comprise one female mating side; and two male mating sides.

The cuboid brick may comprise: one female mating side; at least one male mating side, but not more than five male mating sides; and any side of the brick(s) which are neither male nor female mating sides, are planar.

The male mating side may comprise: a planar wall which defines a side of the brick, from which extends a stud to provide a male engagement feature.

A stud may be provided substantially towards each corner of the male mating side.

The female mating side may further comprise a tube that extends from one or more of the walls of the brick, open on the female mating side, for receiving a shaft member element or the like.

The tube may define a through passage from the external surface of the wall of the brick from which it extends.

The tube may be closed at the end where it extends from the wall of the brick.

The tube may extend from a plane walled side of the brick.

Splines may extend radially inwards from the internal surface of the tube part way across the width of the tube.

The tube may be provided substantially equidistant from each of the studs.

The constructional toy may further comprise a shaft member element comprising splines which extend radially outwards along the length of the shaft.

The shaft may be configured to be received by the tube.

A pair of first and second engagement protrusions may be provided in a corner region of the brick element where the brick element walls meet to form a corner of the female mating side of the brick element; each of the first and second engagement protrusions: extend from the inner surface of a different wall, and extend from a position spaced apart from the corner of the brick element; each of the first and second engagement protrusions terminate in a free end, the engagement protrusion free ends being spaced apart from one another and configured to receive, and to be engageable with, splines of the shaft member element.

The first and second engagement protrusions may each be configured to, at least in part, fit between adjacent shaft member element splines, to thereby engage with and retain the shaft member element.

One of the pair of first and second engagement protrusions may extend from the indented region.

A third engagement protrusion may extend from the inner surface of the brick element corner and terminates in a free end, the third engagement protrusion being spaced apart from, and located between, the first and second engagement protrusions, the first, second and third engagement protrusion free ends being spaced apart from one another such that the third engagement protrusion is configured to face the end of a spline of the shaft member element.

The third engagement protrusion may comprise a support section which extends from the brick element corner, and a flat end section which defines the free end of the support section, wherein the flat end section extends to either side support section, such that the third engagement protrusion is "T" shaped.

A fourth engagement protrusion and fifth engagement protrusion may be provided to either side of the third engagement protrusion the fourth engagement protrusion being spaced apart from, and located between, the first and third engagement protrusions, the fifth engagement protrusion being spaced apart from, and located between, the second and third engagement protrusions, each of the fourth engagement protrusion and fifth engagement protrusion terminating in a free end, the first, second, third, fourth and fifth engagement protrusions free ends being spaced apart from one another.

Third and fourth engagement protrusions may extend from the inner surface of different walls on opposite sides of the corner; the third and fourth engagement protrusions being spaced apart from one another, each terminating in a free end, the third and fourth engagement protrusions being spaced apart from, and located between, the first and second engagement protrusions, the third and fourth engagement protrusion free ends being spaced apart from one another to define a passage.

Accordingly there may be provided a constructional toy comprising a plurality of elements which can be assembled together to form a variety of three dimensional structures, said elements including: a triangular prism shaped brick element comprising a plurality of walls which define: a male mating side having a male engagement feature which extends from the brick; and a female mating side which defines a cavity configured for receiving an engagement feature of the same configuration as provided on the male mating side to thereby link elements of the constructional toy together; the mating sides being square.

The constructional toy may further comprise a cubic brick element comprising a plurality of walls which define male and female mating sides having edges of the same length as the mating sides of the triangular prism shaped brick; and the male and female mating sides of the cubic brick having engagement features complementary in shape to the female and male engagement features respectively of the triangular prism shaped brick.

The triangular prism shaped brick may comprise one female mating side; and one male mating side, or two male mating sides.

The cubic brick may comprise one female mating side; and at least one male mating side, but not more than five male mating sides.

Any side of the brick(s) which are neither male nor female mating sides, may be planar.

The male mating side may comprise: a planar wall which defines a side of the brick, from which extends a stud to provide a male engagement feature.

A stud may be provided substantially towards each corner of the male mating side.

The female mating side may further comprise a tube that extends from one or more of the walls of the brick, open on the female mating side, for receiving a shaft member element or the like.

The constructional toy may further comprise: a shaft member element configured to be received by the tube the shaft member element having a predetermined length such that the shaft may be entered in the tubes of two brick elements to join the brick elements, and enable the female mating side of one of the brick elements to be brought into contact with the female mating side of the other brick element.

The tube may define a through passage from the external surface of the wall of the brick from which it extends.

The tube may be closed at the end where it extends from the wall of the brick.

The tube may extend from a plane walled side of the brick.

Splines may extend radially inwards from the internal surface of the tube part way across the width of the tube.

The tube may be provided substantially equidistant from each of the studs.

There may be provided a constructional toy comprising a plurality of elements which can be assembled together to form a variety of three dimensional structures, said elements including: a triangular prism shaped brick element comprising a plurality of walls which define: a square male mating side having a male engagement feature which extends from the brick; and a cavity which provides a female mating side, the cavity having a square perimeter defined by an edge of each wall, and is configured for receiving an engagement feature of the same configuration as provided on the male mating side to thereby link elements of the constructional toy together; the female mating side comprising: a tube that extends from one or more of the walls of the brick, open on the female mating side, for receiving a shaft member element or the like; the constructional toy further comprising a shaft member element configured to be received by the tube the shaft member element having a predetermined length such that the shaft may be entered in the tubes of two brick elements to join the brick elements, and enable the female mating side of one of the brick elements to be brought into contact with the female mating side of the other brick element.

There may be provided a constructional toy comprising a plurality of elements which can be assembled together to form a variety of three dimensional structures, said elements including: a cubic shaped brick element comprising a plurality of walls which define: a square male mating side having a male engagement feature which extends from the brick; and a cavity which provides a female mating side, the cavity having a square perimeter defined by an edge of each wall, and is configured for receiving an engagement feature of the same configuration as provided on the male mating side to thereby link elements of the constructional toy together; the female mating side comprising: a tube that extends from one or more of the walls of the brick, open on the female mating side, for receiving a shaft member element or the like; the constructional toy further comprising a shaft member element configured to be received by the tube the shaft member element having a predetermined length such that the shaft may be entered in the tubes of two brick elements to join the brick elements, andenable the female mating side of one of the brick elements to be brought into contact with the female mating side of the other brick element.

The shaft length may be in the range of 90% to 99% of twice the length of the edge of a male and/or female mating side.

Hence there is provided a constructional toy having a plurality of elements which can be assembled together to form a variety of three dimensional structures, with the intention of educating a child about mechanics, ergonomics and stimulating the child's intellectual and physical development.

BRIEF DESCRIPTION OF THE DRAWINGS

Examples of the present disclosure will now be described with reference to the accompanying drawings, in which:

FIG. 15 consists of 15A, 15B, 15C which show an assembly of the brick elements of FIGS. 11 to 14;

FIGS. 36 to 38 show an example of internal wall features of the brick elements, and how it may be assembled with shaft elements of FIG. 6, 7 or the like;

DETAILED DESCRIPTION

Figure 1:
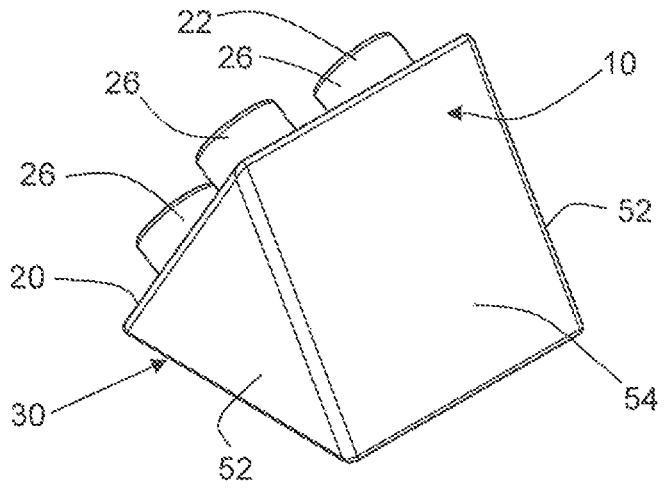
FIGS. 1 to 5 show a plurality of views of an example of a brick of the constructional toy of the present disclosure.
Figure 2:
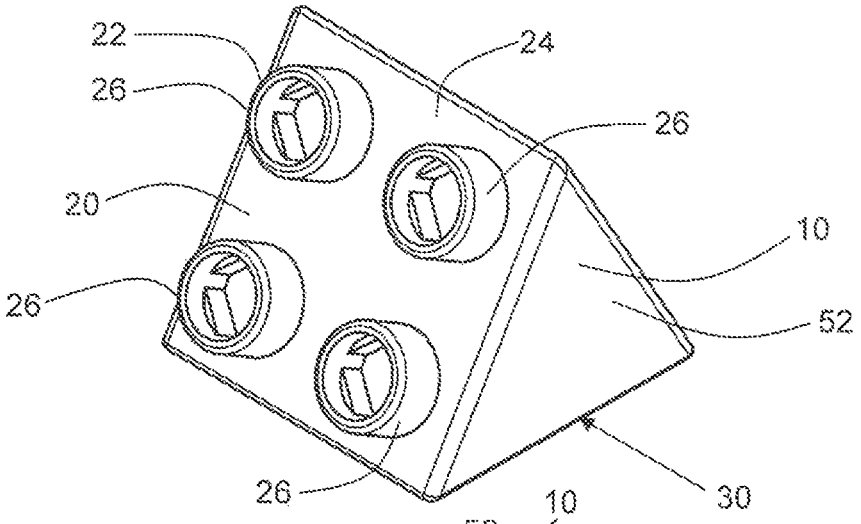
Figure 3:
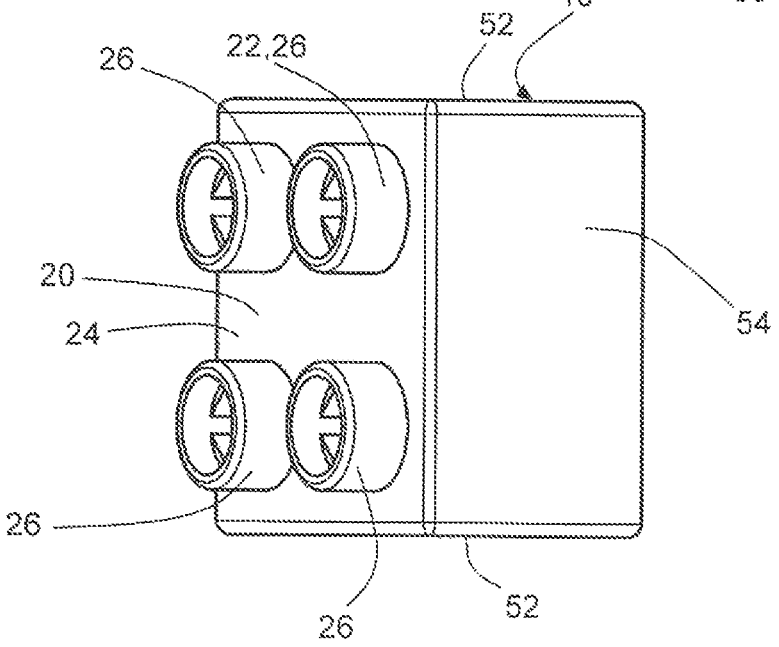

The present disclosure relates to a constructional toy comprising a plurality of elements which can be assembled together to form a variety of three dimensional structures.

FIGS. 1 to 5 and 10 show a first example of a toy brick according to the present disclosure. In this example the brick 10 is provided in the shape of a triangular prism element. The brick 10 comprises a plurality of walls which define mating sides and plane sides of the brick 10. The walls define a male mating side 20 having a male engagement feature 22 which extends from the brick 10. The male mating side 20 comprises a planar wall 24 which defines the side of the brick 10 from which extends a stud 26 to provide the male engagement feature 22. The male mating side is square, that is to say polygonal with sides of equal length. A stud 26 may be provided substantially towards each corner of the male mating side 20.

The brick 10 is also provided with a female mating side 30 which defines a cavity 32 defined by walls of the brick. Hence the walls of the cavity 32 define an opening configured for receiving male engagement features 22 of the same configuration as provided on the male mating side 20, and the walls which define the cavity 32 are configured to frictionally engage with the male engagement features 22 entered in the cavity 32. Hence, elements of the constructional toy of the present disclosure having such male and female engagement features may thereby be linked together.

The female mating side 30 is square, that is to say polygonal with sides of equal length. Put another way, the walls of the brick define a cavity having a perimeter which is square.

That is to say, the triangular prism shaped brick element 10 comprises a plurality of walls which define two square sides 20, 54 angled relative to one another, at least one of which is provided as a male mating side 20 having a male engagement feature 22 (shown as studs 26) which extend from the brick element 10. The walls also define a cavity 32 which provides a female mating side 30 having a square perimeter defined by an edge of each wall.

Figure 4:
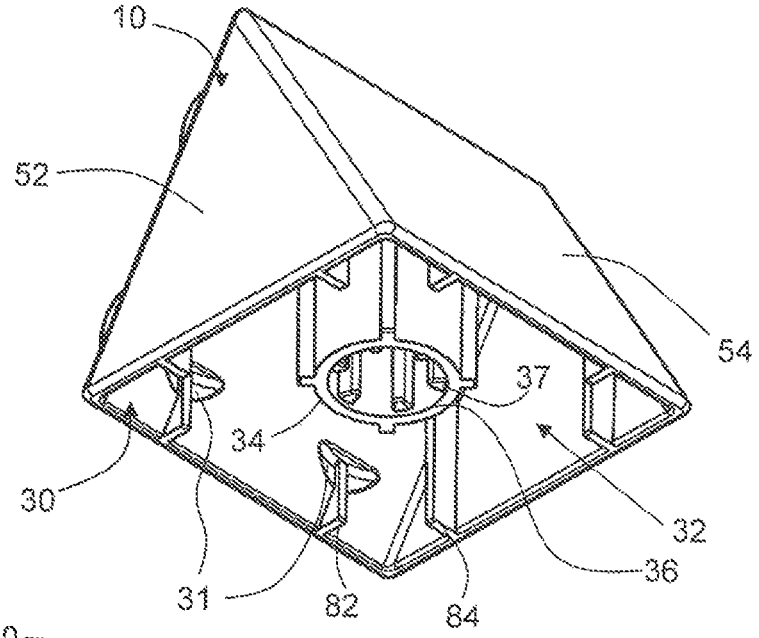
Figure 5:
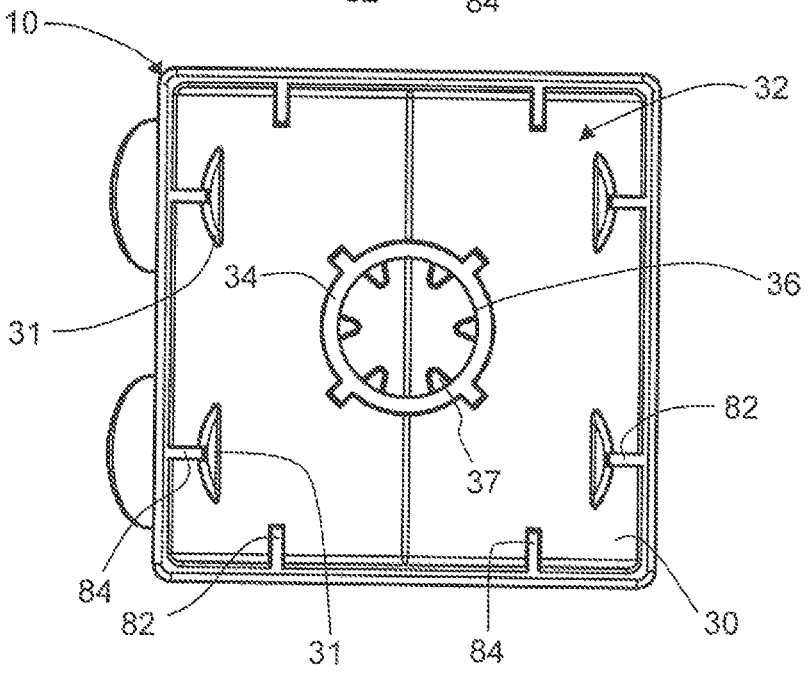

As shown in FIGS. 4, 5, at least one of the square side walls has an indented region 31 on its inner surface.

The cavity 32 is configured for receiving an engagement feature 22 (e.g. studs 26) of the same configuration as provided on the male mating side 20. Hence the indented region may in part be arcuate to correspond to the shape of a stud 26. The indented region 31 is positioned and configured to receive a portion of the engagement feature 22 (e.g. studs 26) to allow the studs 26 to fit further into the cavity 32 to provide a better engagement between brick elements, as will be described later with reference to FIGS. 15*a*, 15*b*, 15*c*.

The female mating side 30 further comprises a tube 34 that extends from one, or more, of the walls of the brick 10 and is open on the female mating side 30 for receiving a shaft member or the like (discussed below). That is to say, a passage or tube 34 extends from the inner side (i.e. within the cavity 32) of one or more wall(s) which define the brick structure 10 towards a plane of the female mating side 30 where it terminates. The tube 34 has an opening 36 on, or proximate to, the plane of the female mating side 30. The opening 36 is defined by the walls of the tube 34. The tube is hollow and, in the example shown in FIG. 4, FIG. 5, has a circular cross section to thereby define a hollow cylindrical tube for receiving a shaft member or the like. In the example shown in FIGS. 4, 5 splines 37 extend radially inwards from the internal surface of the tube 34, such that the splines 37 extend partway across the internal diameter (i.e. the width) of the tube 34. In an alternative example the internal surface of the tube 34 is plane (that is to say there are no splines provided, and the internal surface of the tube 34 is circular in cross section).

Figure 6:
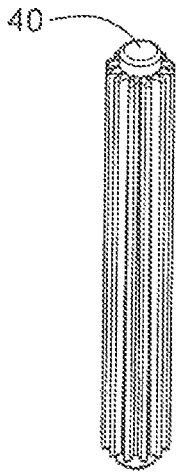
FIGS. 6 to 9 show examples of additional elements that may be used with the brick elements of the constructional toy of the present disclosure.
Figure 7:
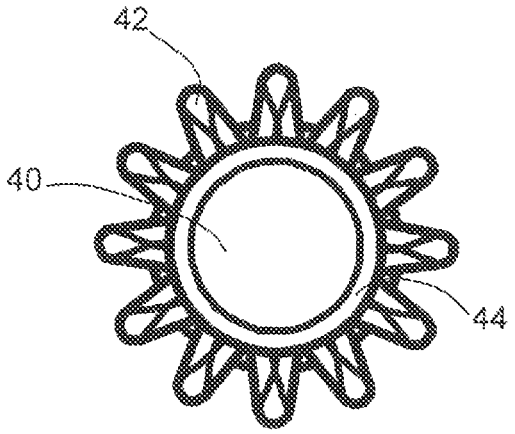
Figure 8:
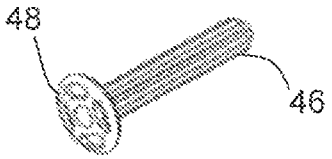
Figure 9:
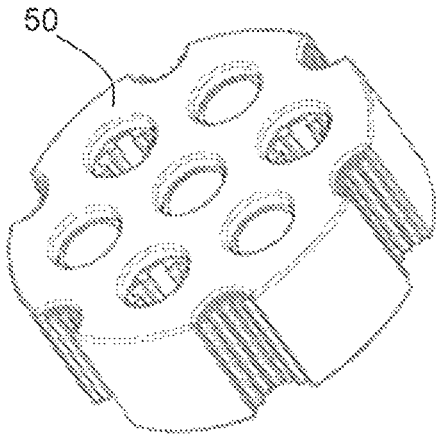
Figure 10:
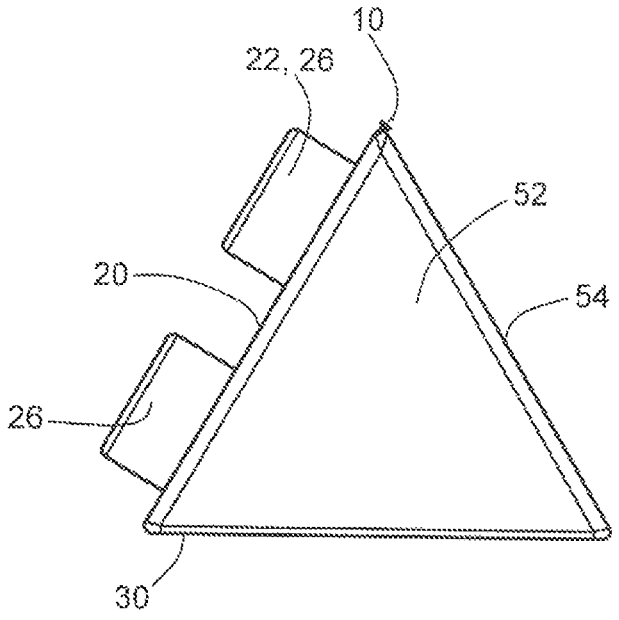
FIG. 10 shows a further view of the brick element example of FIGS. 1 to 5.
Figure 11:
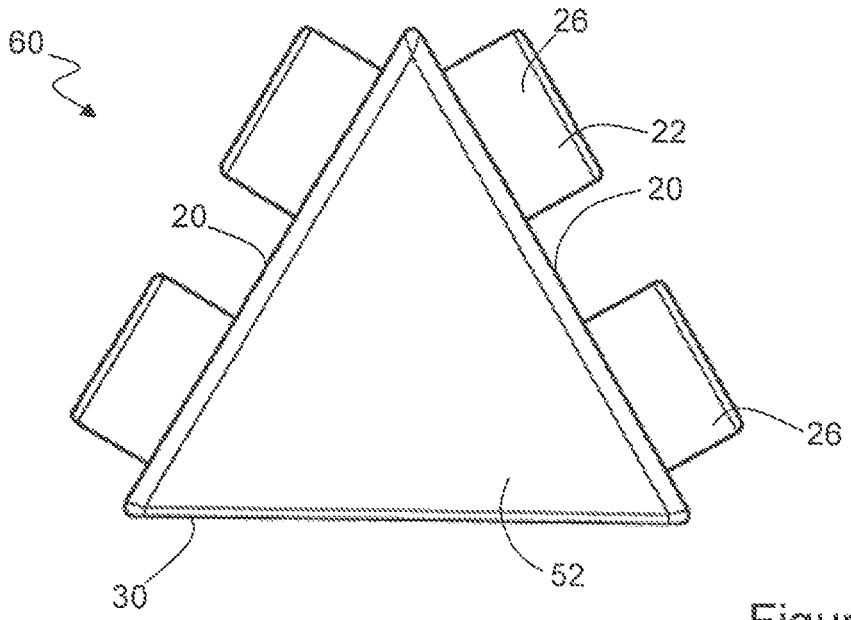
FIGS. 11 to 14 show views of a second example of a brick element of the constructional toy of the present disclosure.
Figure 12:
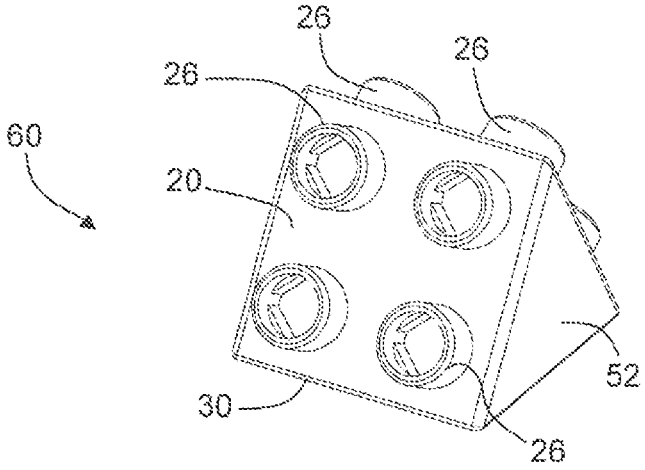
Figure 13:
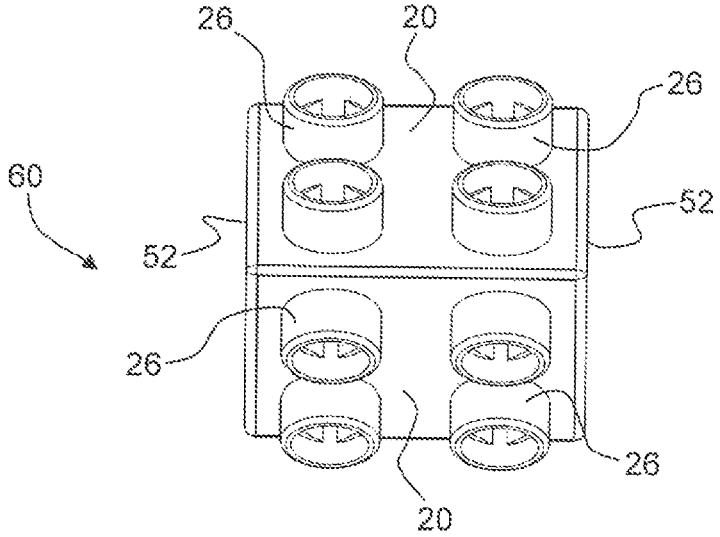

FIGS. 6 to 8 show examples of shaft elements that may be entered into the tube 34 of the brick 10. FIG. 7 shows a cross section partway along the length of the shaft 40, 46 shown in FIG. 6 and FIG. 8. The shaft 40 is splined, that is to say has splines 42 which extend away from a central cylindrical core 44 of the shaft. That is to say, the splines extend radially outwards along the length of the shaft. The shaft 46 shown in FIG. 8 is likewise splined, and is also provided with a flange 48 which extends away in a radial direction at one end of the shaft 46 to provide a stopper member. A wheel member element 50 as shown in FIG. 9 may also form part of the constructional toy, joined to the bricks by use of the shafts 40, 46. An example of such an assembly will be described later. The shafts 40, 46 may be entered in the tube 36 of the brick 10. That is to say, the shafts 40, 46 are configured to be received by the tube 36. In examples where the bricks have tubes 36 which are planar (i.e. no splines), the shaft 40, 46 will be free to rotate within the tube 36. In examples where the tube 36 comprises splines, the splines 42 of the shafts 40, 46 will engage with the splines 36 of the tube 34 such that the shaft and brick are fixed relative to one another.

The triangular prism shaped brick 10 may comprise one female mating side 30 and one male mating side 20 as shown in FIGS. 1 to 5, 10.

Any side of the brick 10 which is neither male nor female side is planar. Hence, the triangular sides 52 of the triangular prism shape brick 10 are flat and are not provided with any studs or engagement features of any sort. Additionally, the remaining square face 54, which is opposite the female mating side 30 and the male mating side 20 is likewise planar and smooth. Hence in this example, the brick 10 comprises one female mating side 30, one male mating side 20 and three planar sides 52,54. The tube 34 extends from the ridge formed between the male side 20 and the planar side 54.

FIGS. 11 to 14 show a second example of a triangular prism shaped brick 60. Features of the second example of the triangular prism shaped brick 60 which are common to those of the first example of the triangular prism shaped brick 10 are identified using the same reference numerals.

The bricks 10, 60 are identical other than the second example brick 60 comprises two male mating sides 20 rather than one. Hence studs 26 are provided on two planar walls of the brick 60 to form a pair of male engagement features 22. Hence in this example, the brick 10 comprises one female mating side 30, two male mating sides 20 and two planar sides 52.

The mating sides, that is to say both the male mating side 20 and the female mating side 30, are square and have sides of equal length. Put another way, the male mating side has edges of the same length and orientation as the female mating side.

Hence, the triangular prism shaped brick element of the present disclosure comprises one female mating side 30. The female mating side 30 may comprise a tube 34 that extends from one, or more, of the walls of the brick 10 and is open on the female mating side 30 for receiving a shaft member or the like. The triangular prism element may be provided with one male mating side 20. Alternatively, the triangular prism element may be provided with two male mating sides 20.

FIG. 15A, 15B, 15C show an example of how triangular prism elements of the present invention may be fitted together, and how the studs 26 fit inside the region defined by indent 31. This applies equally to how the male engagement feature 20 (i.e. studs 26) of a cuboid brick element may be entered into the cavity 32 of the triangular prism elements 10, 60. FIGS. 15A, 15B show the elements spaced apart, and FIG. 15C shows the same elements when assembled.

The indented region 31 is positioned and configured to receive a portion of the engagement feature 20. That is to say, the indented region 31 is located, sized and shaped so that part of the male engagement feature 20 which is compatible with the triangular prism's cavity 32 may be received in the indented region 32 on the inner wall of the triangular prism shaped brick 10, 60.

The indent feature 31 allows for a longer engagement feature 20 (stud 26) to be entered in the cavity 32 to provide for a positive engagement despite the tapering side walls of the triangular prism shaped brick cavity 32. In the absence of the indent 31, the engagement studs 26 must be slightly shorter, which provides for a less positive fit. Put another way, the indent 31 provides extra room for a stud 26 to fit within the cavity 32 of an adjoining brick, thus improving the join between brick elements.

As shown in FIGS. 16 to 35, the constructional toy according to the present invention may further comprise a cuboid brick element. Akin to the triangular prism shaped brick element of the preceding examples, the cuboid element comprises a plurality of walls which define male and female mating sides, including a cavity which provides the female mating side. The cavity is defined by the plurality of walls. The male and female mating sides of the cuboid brick element have engagement features complementary in shape to the female and male engagement features respectively of the triangular prism shaped brick element 10, 60.

The cuboid brick element may be provided as a cubic brick element comprising a plurality of walls which define male and female mating sides having edges of the same length as the mating sides of the triangular prism shaped brick 10, 60. Hence the male and female mating sides of the cubic brick are also provided with engagement features complementary in shape to the female and male engagement features respectively of the triangular prism shaped brick 10, 60. That is to say, the male mating side 74 comprises a planar wall which defines the side of the cubic brick from which extends a stud 26, or number of studs 26, to provide the male engagement feature 22. The cubic brick is also provided with a female mating side 72 which defines a cavity 32 defined by walls of the brick. Hence the walls of the cavity 32 define an opening configured for receiving male engagement features 22 of the same configuration as provided on the male mating side 74, and the walls which define the cavity 32 are configured to frictionally engage with the male engagement features 22 entered in the cavity 32. Hence, elements of the constructional toy of the present disclosure having such male and female engagement features may thereby be linked together.

The female mating side 72 is square, that is to say polygonal with sides of equal length. Put another way, the walls of the brick define a cavity having a perimeter which is square.

FIGS. 16 to 19 show a cubic brick 70 which comprises one female mating side 72 which is identical to the female mating side 30 of the triangular prism shaped bricks 10, 60. The cubic brick 70 is also provided with a male mating side 74 which is identical in configuration to the male mating side 20 of the triangular prism shaped brick 10, 60. Likewise, planar sides 76 of the brick 70, namely all of the remaining sides of the brick 70, are planar, and are identical to the plane side 54 of the triangular prism shaped brick 10, 60.

Likewise, the cubic brick 70 is provided with a tube 78 that extends from one of the walls of the brick, and is open on the female mating side 72, for receiving a shaft member 40,46 or the like as discussed previously. The tube 78 is closed at the end where it meets the wall of the brick 70.

Figure 14:
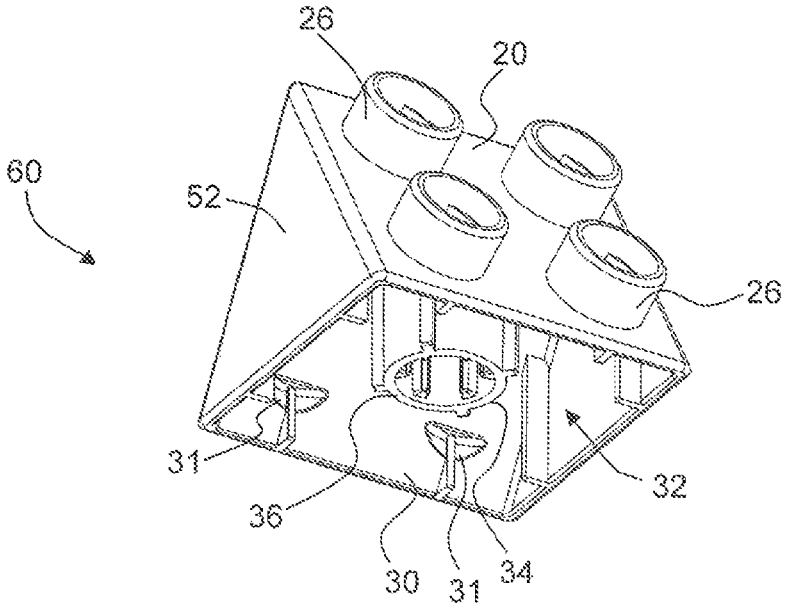
Figure 16:
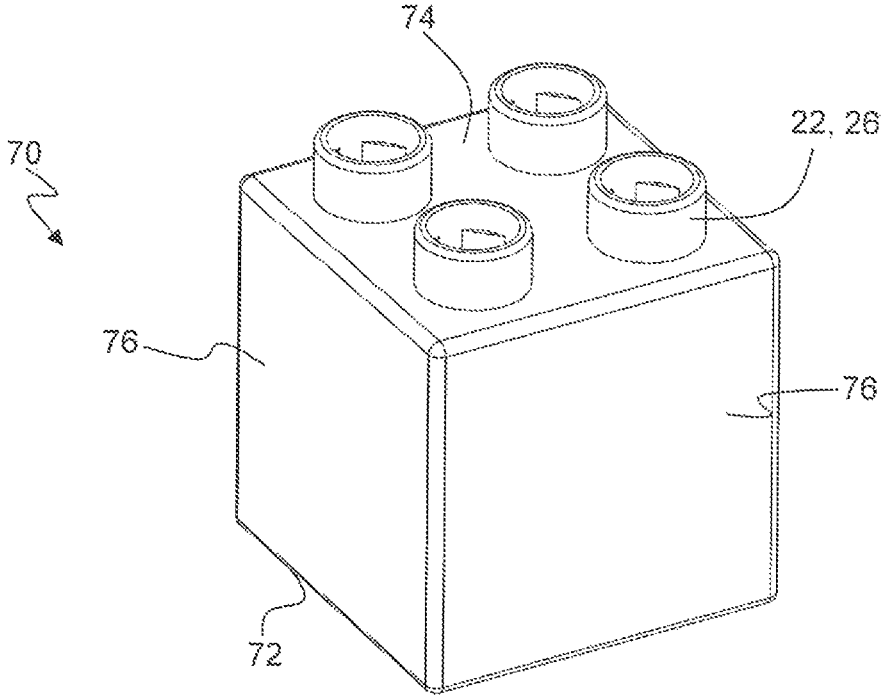
FIGS. 16 to 19 show a third example of a brick element of the constructional toy of the present disclosure.
Figure 17:
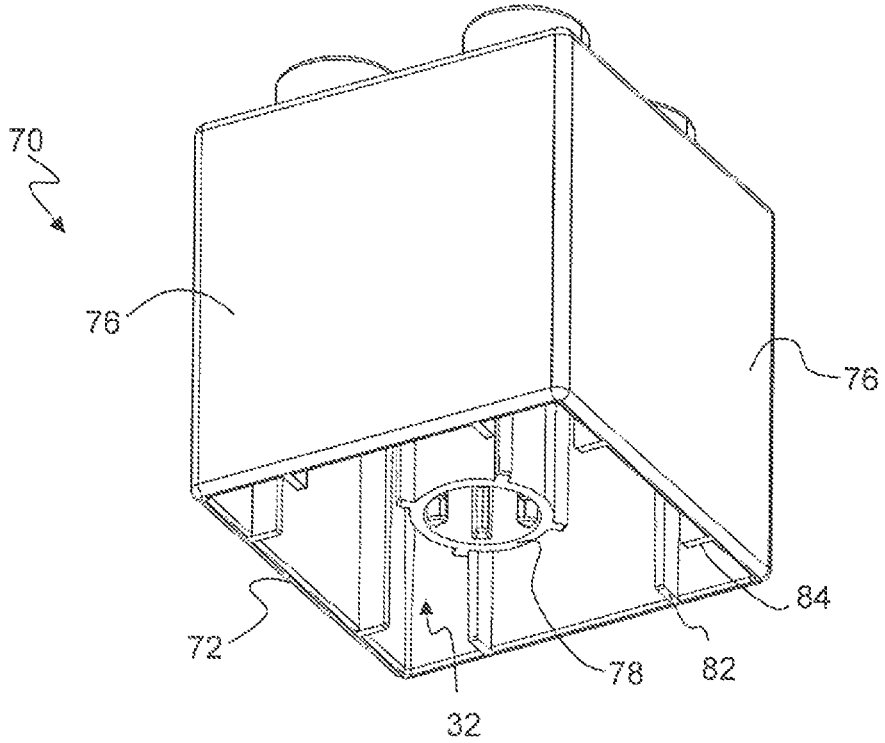
Figure 18:
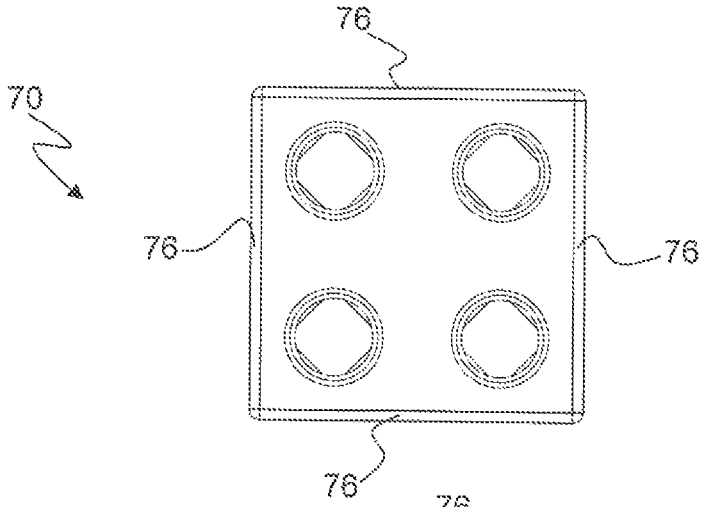
Figure 19:
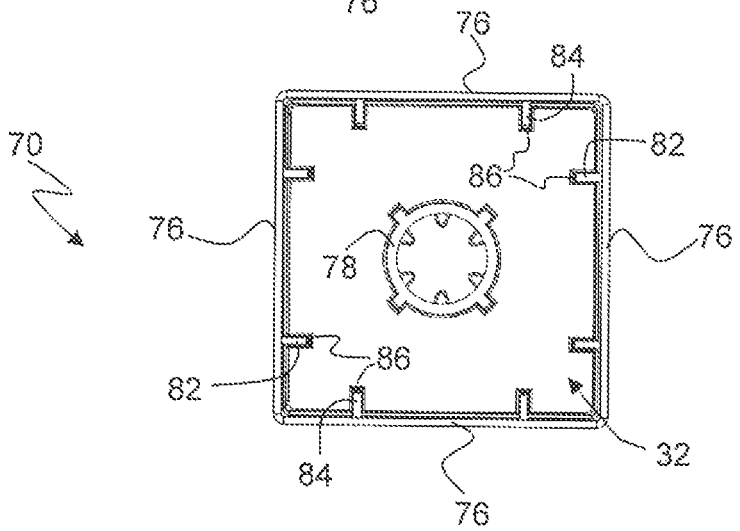

As shown in FIGS. 17, 19, a pair of first and second protrusions 82, 84 are provided in a corner region of the brick element where the brick element walls meet to form a corner of the female mating side 72 of the brick element. Such protrusions 82, 84 are also provided on the triangular prism shaped brick element as shown in FIGS. 4, 5, 14. In some examples the protrusions 82, 84 are for engagement with studs 26 of other brick elements and/or engagement with shaft member elements 40, 46, for example as shown in FIGS. 6, 7, 8. Hence, in some examples, the first and second protrusions 82, 84 are shaft engagement protrusions, and may additionally or alternatively be configured and provided as stud engagement protrusions.

Each of the first and second engagement protrusions 82, 84 extend from the inner surface of a different wall of the brick element, on opposite sides of the corner where their respective walls meet. Each of the first and second engagement protrusions 82, 84 extend from a position spaced apart from the internal corner of the brick element. The engagement protrusions 82, 84 may be provided as thin walls and extend perpendicular to the wall from which they extend from. Each of the first and second engagement protrusions 82, 84 terminate in a free end 86.

As shown in FIGS. 4, 5 in respect of the triangular prism shaped element, one of the pair of first and second engagement protrusions 82, 84 extends from the indented region 31.

In all of the brick elements herein described, the engagement protrusion free ends 86 may be spaced apart from one another to receive, and be engaged with, the side of the male engagement features 20 (for example studs 26) of the male mating side of the brick elements, for example as shown in FIG. 15*c*. They may additionally, or alternatively, be configured to receive and engage with splines 42 of the shaft member element 40, 46. This is described in more detail in relation to FIGS. 36 to 38, 39 to 41, 42 to 44, 45 to 47, 48 to 50 and 51 to 53.

Figure 20:
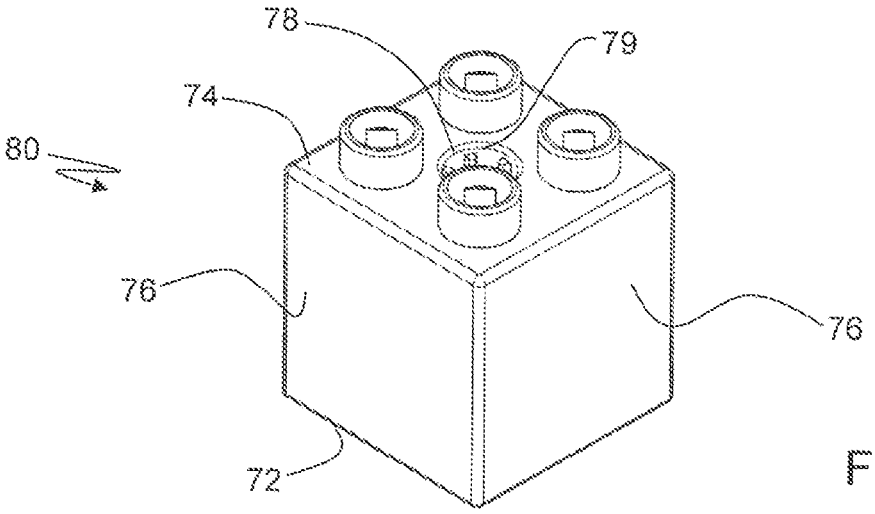
FIG. 20 shows a fourth example of a brick element, similar to the examples of FIGS. 16 to 19.

In a further example, shown in FIG. 20, a second example of a cubic brick is shown, which is identical to the brick example of FIGS. 16 to 19 except that the tube 78 defines a through passage from the external surface of the wall of the brick from which it extends. That is to say, an aperture 79 on the male mating side 74 provides an opening into the passage defined by the tube 78, and the passage extends to the plane of the female mating side 72. Hence the tube 78 defines a through passage from the external surface of the wall 74 of the brick from which it extends. Hence a shaft member 40, 46 may extend all the way through the brick and be proud of either, or both, the male mating side 74 or the female mating side 72.

Hence, in the examples of FIG. 16 to 20 the cubic brick 70, 80 comprises one female mating side 72 and one male mating side 74. The remaining external sides 76 of the bricks, i.e. those which are neither male nor female mating sides, are plane sided. That is to say the remaining external sides 76 of the bricks are smooth and planar. Put another way, the bricks 70,80 comprise one female mating side 72, one male mating side 74 and four planar sides 76.

Figure 21:
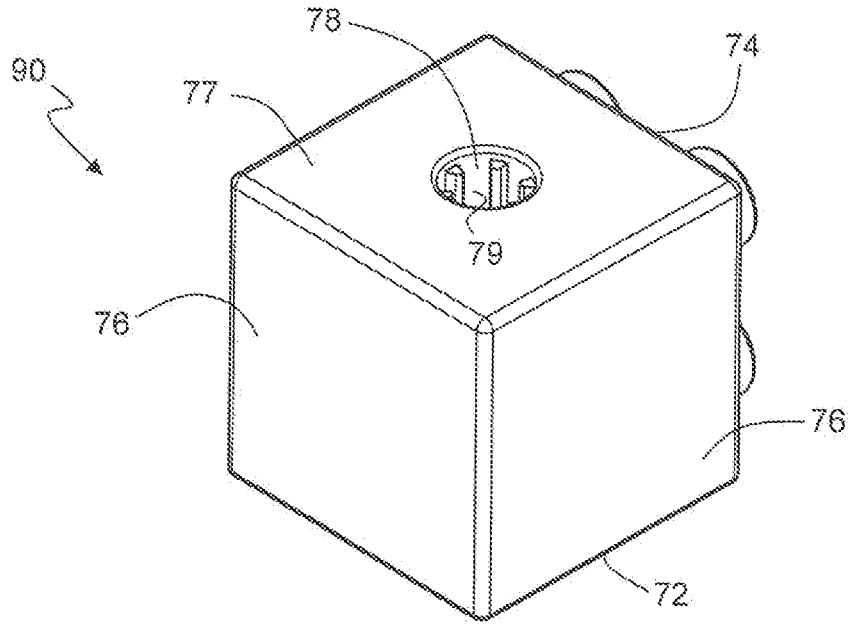
FIGS. 21, 22 show a fifth example of a brick element according to the present disclosure.
Figure 22:
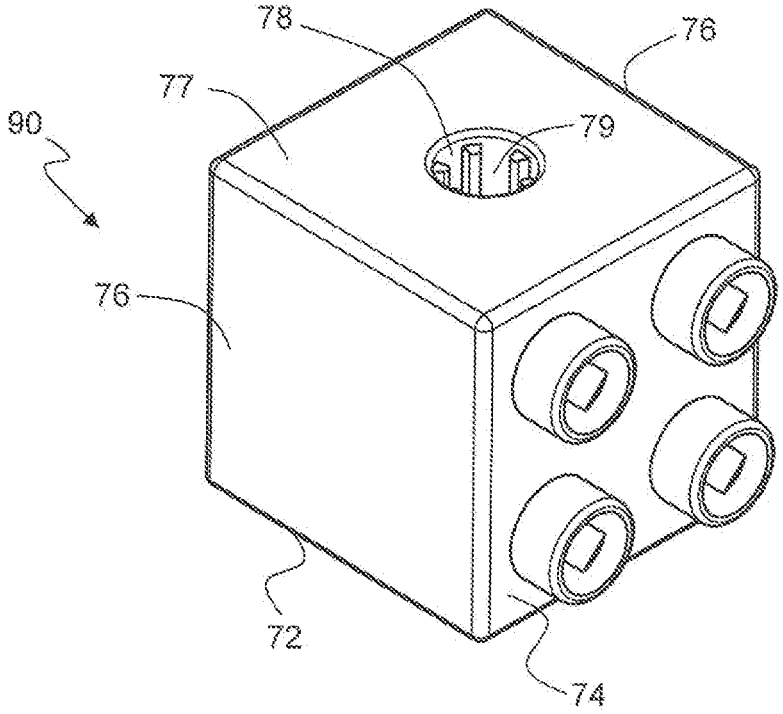
Figure 23:
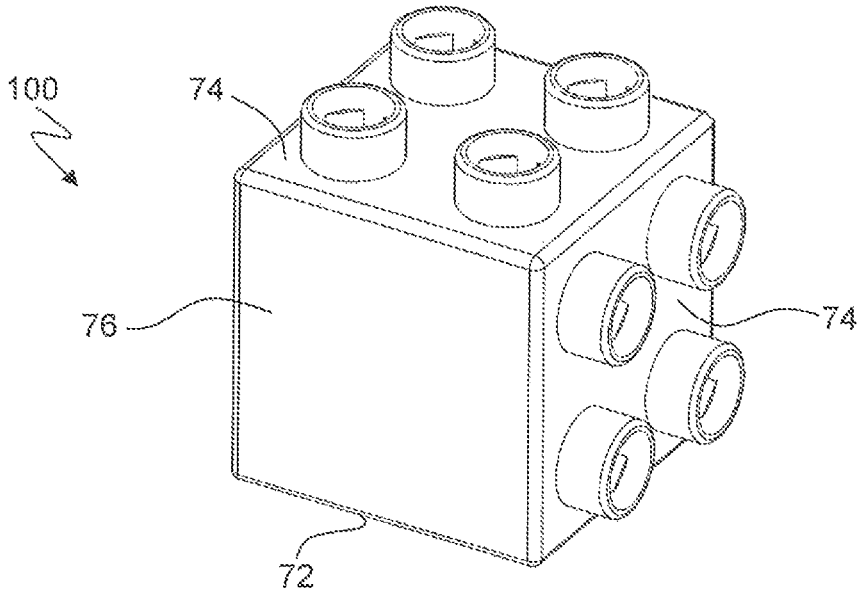
FIGS. 23 to 26 show a sixth example of a brick element according to the present disclosure.
Figure 24:
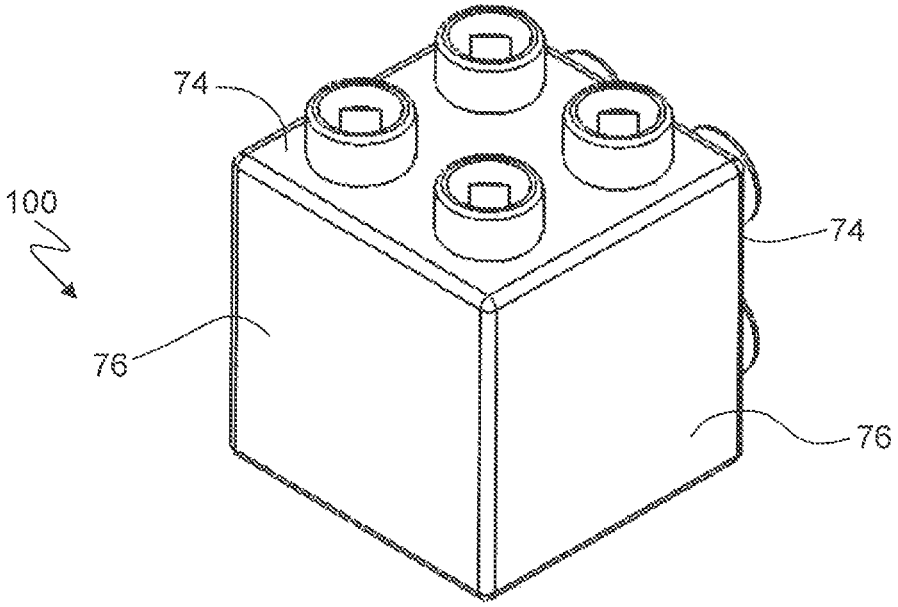
Figure 25:
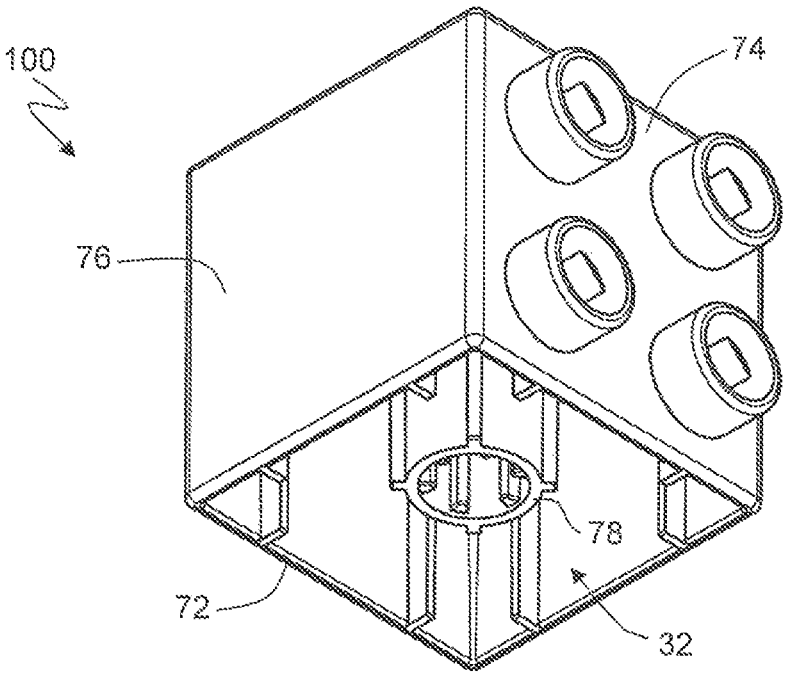
Figure 26:
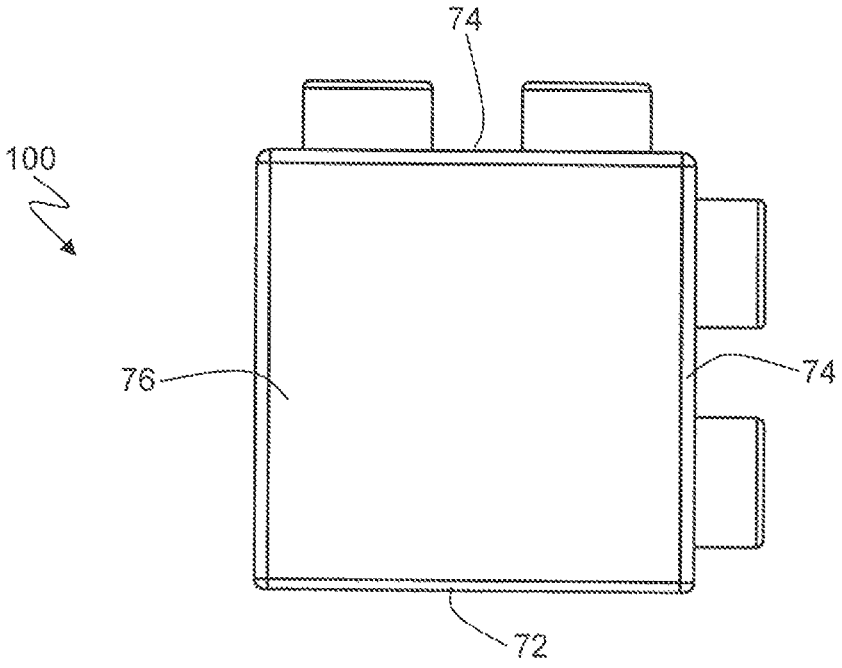

A further example of a brick of the constructional toy of the present disclosure is shown in FIGS. 21 to 22. The brick 90 shown is similar to the example of FIG. 20, except the male mating side 74 is provided on a wall which defines one edge of the female mating side 72, and a tube 78 is provided on the wall of the brick 90 opposite the female mating feature 72. Hence, in this example the cubic brick 90 comprises one female mating side 72 and one male mating side 74, and a planar side 77 which has an aperture 79 leading to the tube 78 which in turn will extend to the female mating side plane 72. That is to say, in this example, the brick 70 comprises one female mating side 72, one male mating side 74, three continuous planar sides 76, and one planar side 77 which is provided with an aperture 79 such that the tube 78 defines a through passage from the external surface of the wall 77 of the brick from which it extends.

Another example of a cubic brick 100 is shown in FIGS. 23 to 26. This example is the same as the brick 70 of FIGS. 16 to 19, except that an additional male mating side 74 is provided on a wall which defines one edge of the female mating side 72. In all other respects, the brick 100 is identical to the brick 70. Put another way, the brick 100 comprises one female mating side 72, two male mating sides 74, three planar sides 76, and the tube 78 is closed at the end where it meets the wall 74 of the brick 70.

Figure 27:
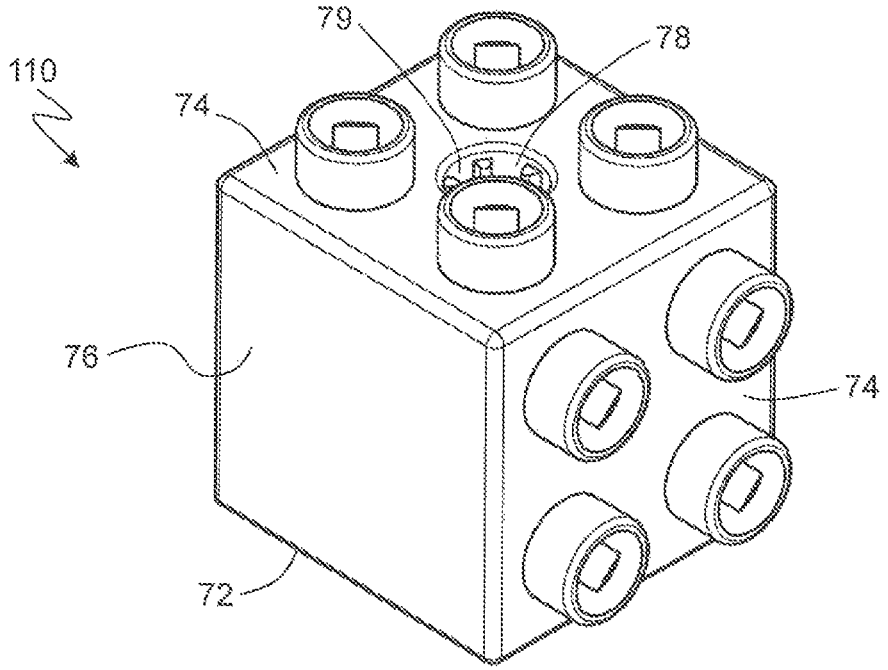
FIGS. 27, 28 show a sixth example of a brick element according to the present disclosure, similar to the examples of FIGS. 23 to 26.
Figure 28:
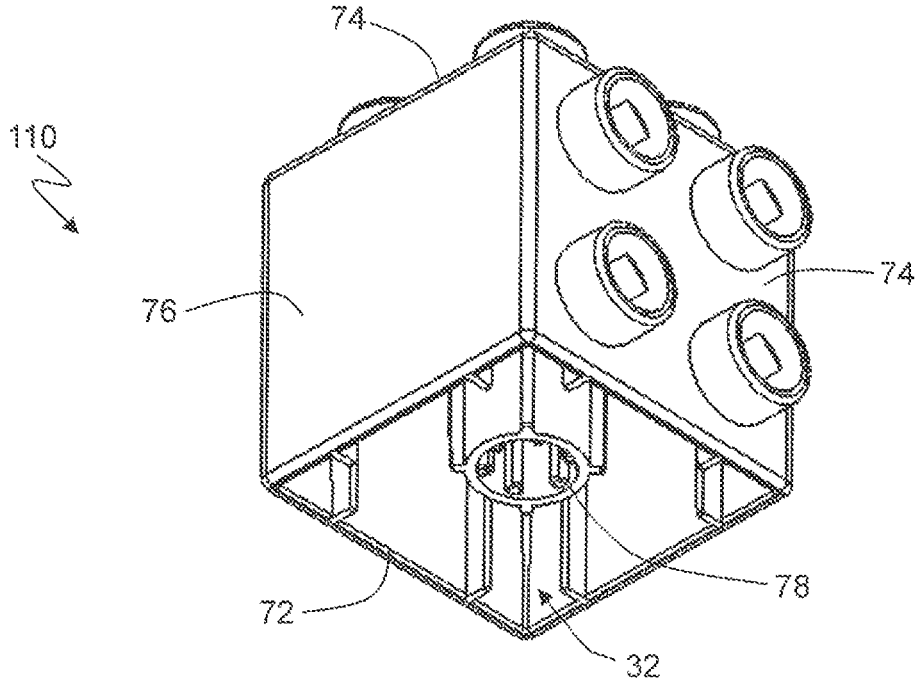
Figure 29:
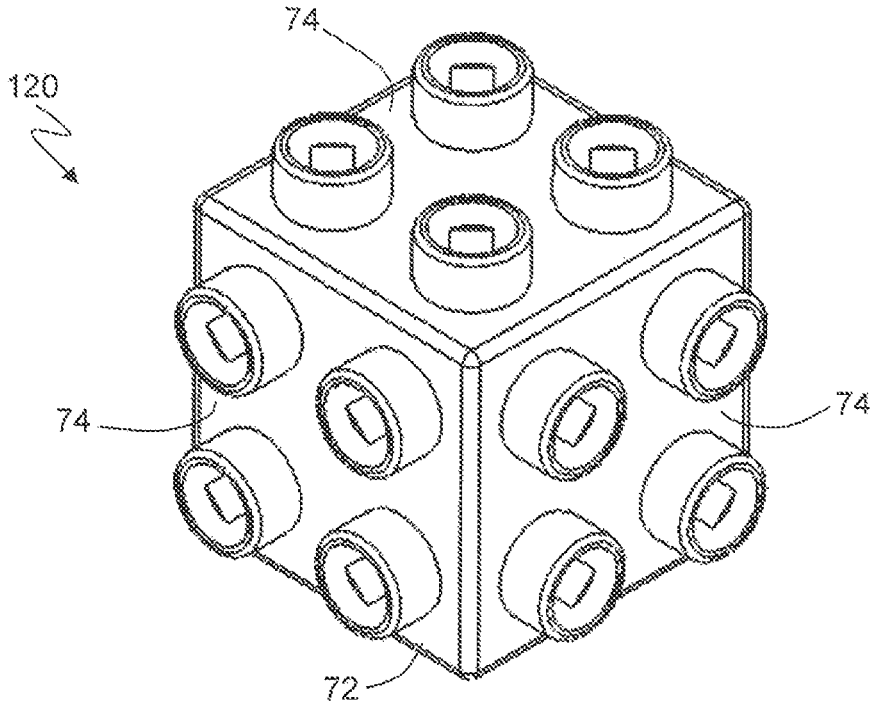
FIGS. 29 to 33 show a seventh example of a brick element according to the present disclosure.
Figure 30:
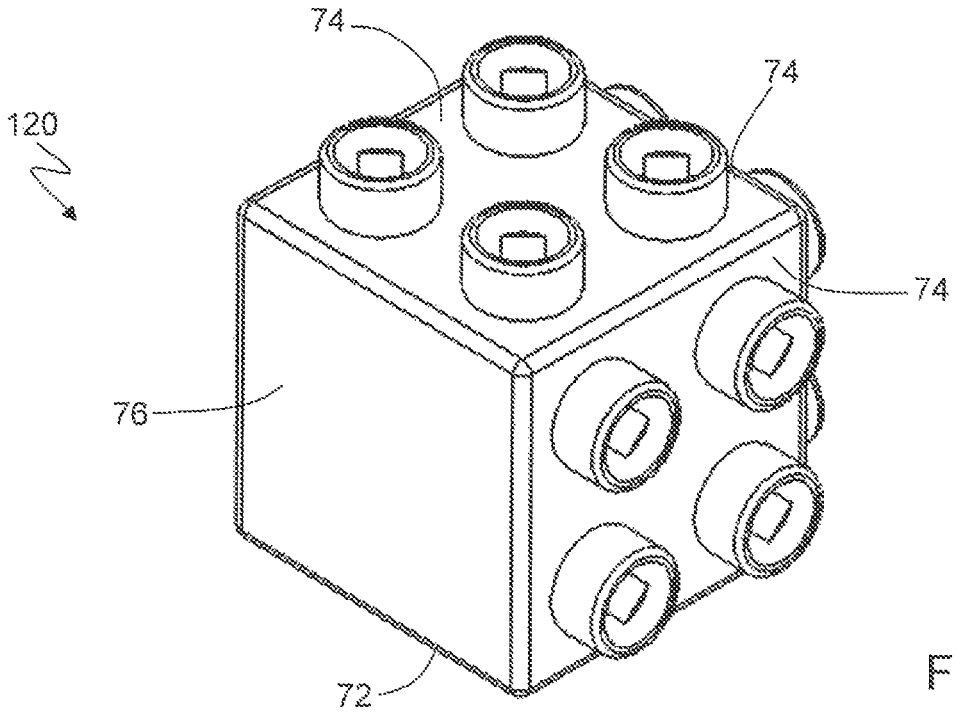
Figure 31:
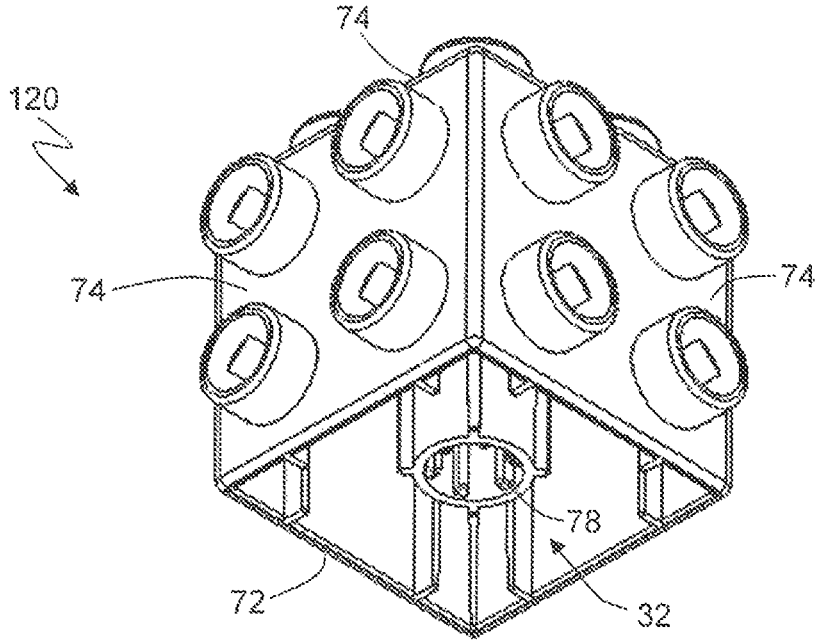
Figure 32:
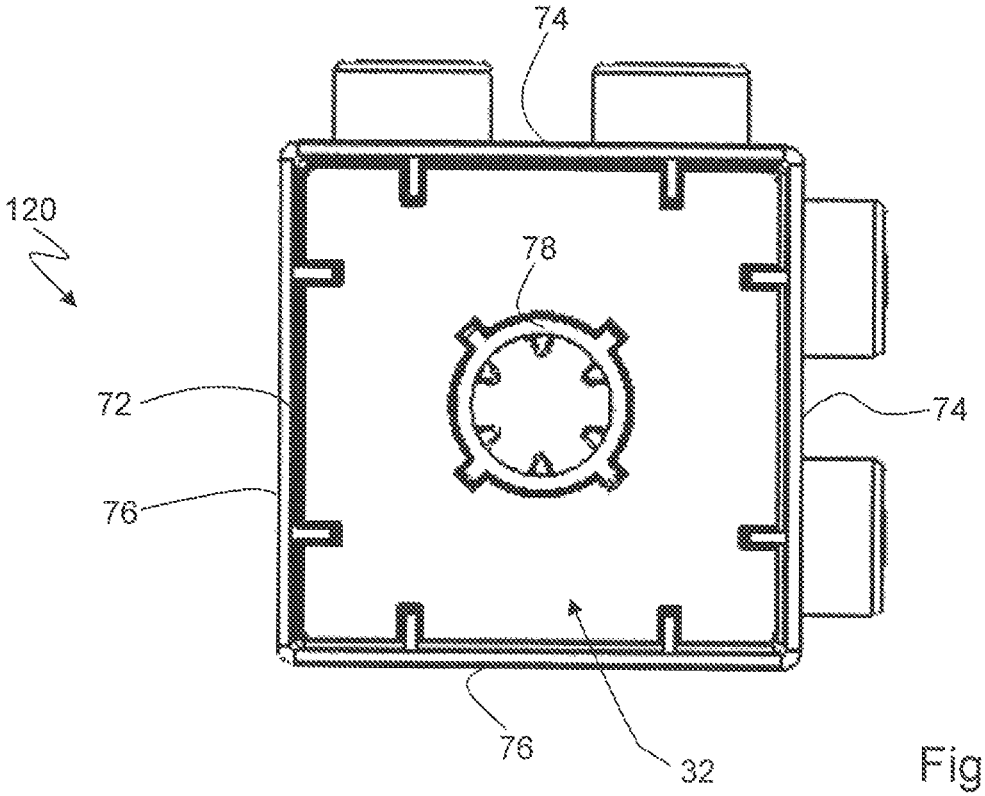
Figure 33:
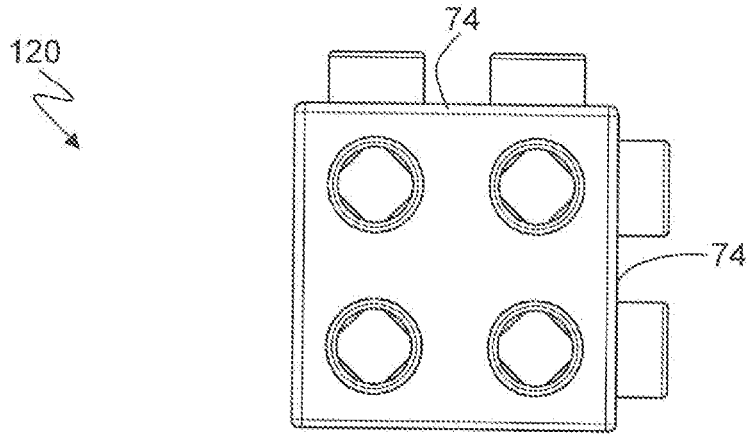

A further example brick 110 is shown in FIGS. 27 to 28. This is identical to the examples of the brick 100 of FIGS. 23 to 26, except that the tube 78 extends through the wall of the brick 110 opposite to the female mating surface 72 of the same brick. That is to say one of the male mating sides 74 is provided with an aperture 79 which opens into the tube 78 such that the tube 78 defines a through passage from the external surface of the wall 74 of the brick from which it extends. In all other respects, brick 110 is the same as brick 100.

A further example of a cubic brick according to the present disclosure is shown in FIGS. 29 to 33. This is identical to the brick 100 of FIGS. 23 to 26, except male mating surfaces 74 are provided on three of the walls of the brick 120, including the wall of the brick 120 opposite the female mating side 72. Hence in this example, the cubic brick comprises one female mating side 72, three male mating sides 74, and one planar side 76, and the tube 78 is closed at the end where it meets the wall 74 of the brick 70.

Figure 34:
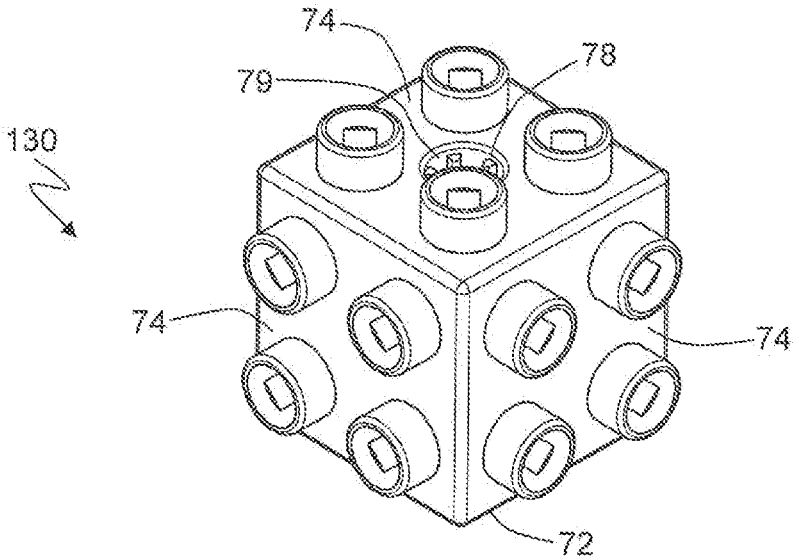
FIGS. 34, 35 show an eighth example of a brick element according to the present disclosure, similar to the examples of FIGS. 29 to 33.
Figure 35:
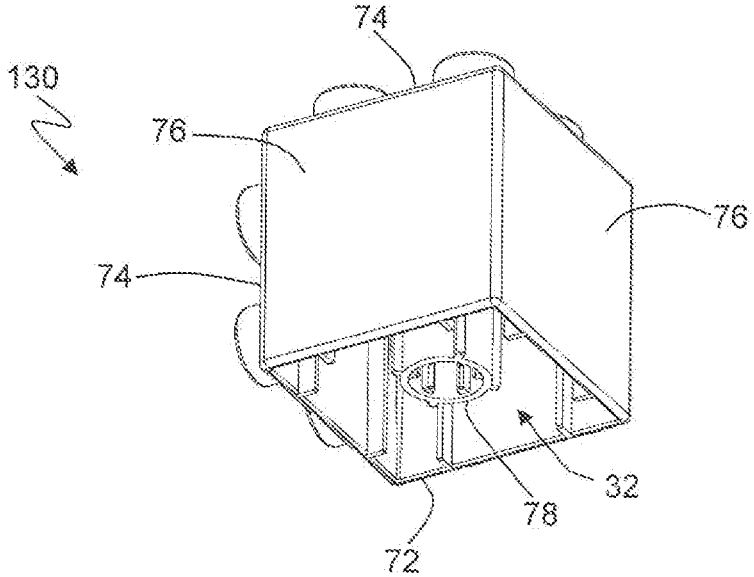

A further example of a cubic brick 130 is shown in FIGS. 34, 35. This is identical to the example brick 120 shown in FIGS. 29 to 33, except the tube 78 extends through the wall of the male mating surface side 74 opposite the female mating side 72. Hence in this example, the cubic brick comprises one female mating side 72, three male mating sides 74, and one planar side 76, and one of the male mating sides 74 is provided with an aperture 79 which opens into the tube 78 such that the tube 78 defines a through passage from the external surface of the wall 74 of the brick from which it extends.

In all of the examples above, any side walls of the brick(s) which are neither male nor female mating sides, are planar.

In each of the examples where studs are provided as male engagement features, the studs are provided substantially towards each corner of the male mating side.

The tube 78 may be provided substantially equidistant from each of the studs provided on a male mating side. That is to say, whether the tube 78 extends through the wall of the brick, or whether the tube is closed on the wall of the brick from which it extends, the tube 78 may be provided substantially equidistant from each of the studs, that is to say at the centre of the wall from which it extends.

In examples where the tube 78 extends from a planar wall, it may be provided towards the centre of the planar wall.

Hence, the cubic brick element of the present disclosure comprises one female mating side 72. The female mating side 72 may comprise a tube 78 that extends from one of the walls of the brick and is open on the female mating side 72 for receiving a shaft member or the like. The cubic brick element may be provided with at least one male mating side 74, but not more than five male mating sides 74.

Any side of the brick elements of the present disclosure which are neither male nor female mating sides, are planar.

As described previously in relation to FIGS. 4, 5, 14, 15*a-c*, 17 and 19, first and second engagement protrusions 82, 84 are provided in a corner region of each of the brick elements where the brick element walls meet to form a corner of the female mating side 30, 72 of the brick element.

Figure 37:
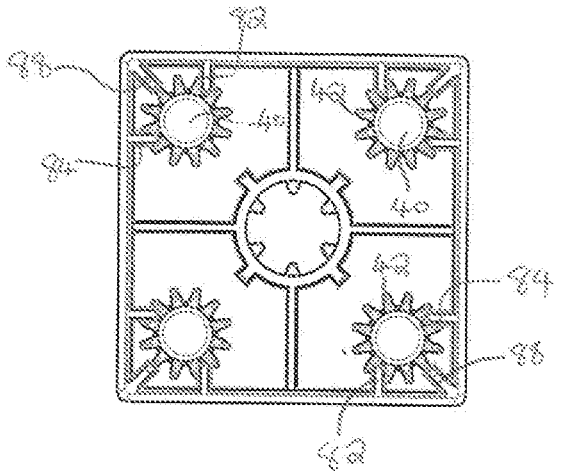

Although several different examples of engagement protrusions 82, 84 are shown in the present disclosure, common to all, as shown in FIG. 37, is that the first and second engagement protrusions 82, 84 are each configured (i.e. sized), at least in part, to fit between adjacent shaft member element splines 42, to thereby engage with and retain the shaft member element 40 in the brick element. That is to say, the splines 42 and engagement protrusions 82, 84 are configured to have relative lengths such that the splines 42 may be slid into the region defined by the engagement protrusions 82, 84 and held in position as required, and then slid out again when desired. Put another way, the first and second engagement protrusions 82, 84 and shaft member element splines 42 are configured to have relative dimensions such that the free ends 86 of the engagement protrusions 82, 84 may extend between different pairs of splines 42, and such that the first and second engagement protrusions 82, 84 may releasably engage with the splines 42 so the shaft 40 may be slid into a corner of the brick element, held in position and slid out of the corner of the brick element. In the examples of FIGS. 4, 5, 14, 15*a-c*, 17 and 19, the first and second engagement protrusions free ends 86 are spaced apart from one another to receive, and engage with, the male engagement feature 20 (e.g. stud 26) of another brick element.

Figure 36:
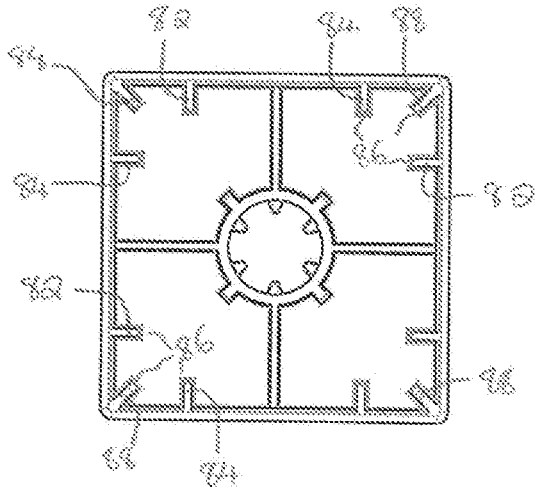
Figure 38:
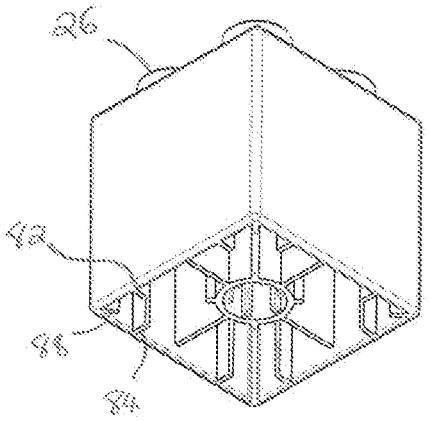

As shown in the examples of FIGS. 36 to 38, a third engagement protrusion 88 extends from the inner surface of the corner of the brick element, to terminate in a free end 86. The third engagement protrusion 88 may be provided as a thin wall structure. The third engagement protrusion 88 is spaced apart from, and located between, the first and second engagement protrusions 82, 84. Additionally the engagement protrusion free ends 86 are spaced apart from one another such that, when assembled with a shaft 40, the free end 86 of the third engagement protrusion 88 faces the end of a spline 42 of the shaft member element 40. The third engagement protrusion 88 may abut (i.e. support or engage with) the end of a spline 42 of the shaft member element 40, assisting in holding the shaft member element 40 in engagement with the brick element. In this example the first, second and third engagement protrusions free ends 86 are spaced apart from one another such that they are configured to receive, and engage with, the male engagement feature 20 (e.g. stud 26) of another brick element.

Figure 39:
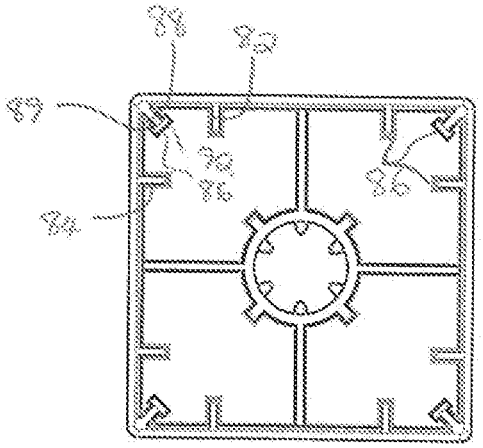
FIGS. 39 to 41 show a further alternative example of brick element internal wall geometry, and how it may be used.
Figure 40:
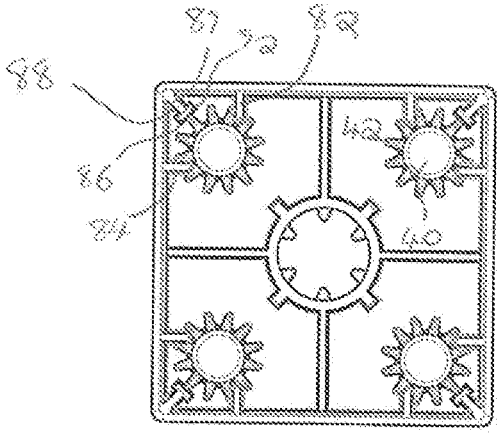
Figure 41:
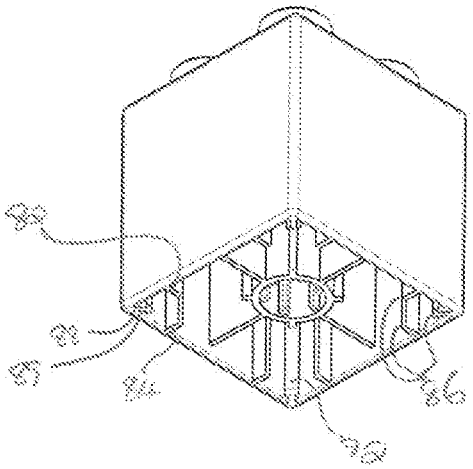

In an alternative example shown in FIGS. 39 to 41 the third engagement protrusion 88 comprises a support section 89 which extends from the brick element corner, and a flat end section 92 which defines the free end 86 of the support section 86. The flat end section 92 extends to either side of the support section 88 such that the third engagement protrusion 88 is "T" shaped. As shown in FIG. 40, the engagement protrusion free ends 86 are spaced apart from one another such that, when assembled with the shaft element member 40, the free end 86 (flat end section 92) of the third engagement protrusion 88 abuts the end of a spline 42 of the shaft member element 40, assisting in holding the shaft member element 40 in position in engagement with the brick element. In this example, the first, second and third engagement protrusions free ends 86 are spaced apart from one another such that they are configured to receive, and engage with, the male engagement feature 20 (e.g. stud 26) of another brick element.

Figure 42:
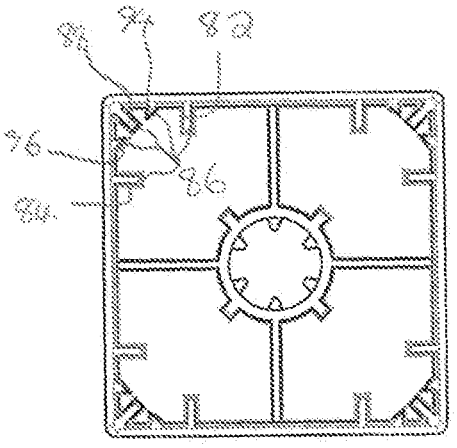
FIGS. 42 to 44 show another alternative example of brick element internal wall geometry, and how it may be used.
Figure 43:
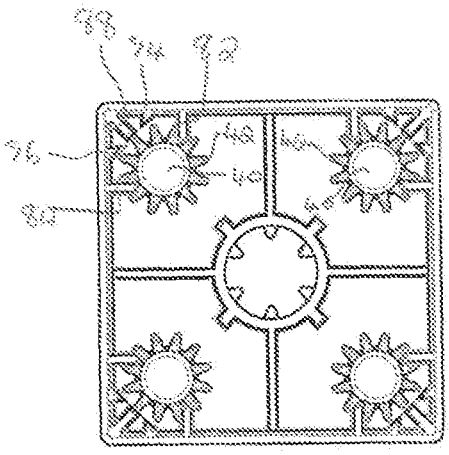
Figure 44:
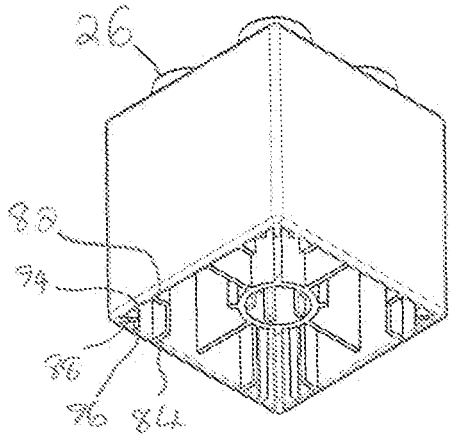
Figure 45:
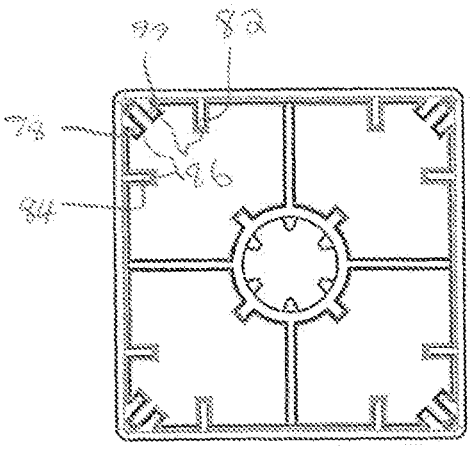
FIGS. 45 to 47 show a further alternative example of brick element internal wall geometry, and how it may be used.

In an alternative example shown in FIGS. 42 to 44, a fourth engagement protrusion 94 and fifth engagement protrusion 96 are provided to either side of the third engagement protrusion 88. The fourth engagement protrusion 94 and fifth engagement protrusion 96 may be provided as thin wall structures. The fourth engagement protrusion 94 is spaced apart from, and located between, the first and third engagement protrusions 82, 88. The fifth engagement protrusion 96 is spaced apart from, and located between, the second and third engagement protrusions 84, 88. Each of the fourth engagement protrusion 94 and fifth engagement protrusion 96 terminate in a free end 86. Each of the fourth engagement protrusion 94 and fifth engagement protrusion 96 are shorter than the first, second or third engagement protrusions. The first, second, third, fourth and fifth engagement protrusions free ends 86 are spaced apart from one another such that they are configured to receive, and engage with, the male engagement feature 20 (e.g. stud 26) of another brick element. The fourth and fifth engagement protrusions 94, 96 are also configured such that, when assembled with a shaft element member 40, their free ends are spaced apart from the splines 42 of the shaft member element 40.

Figure 46:
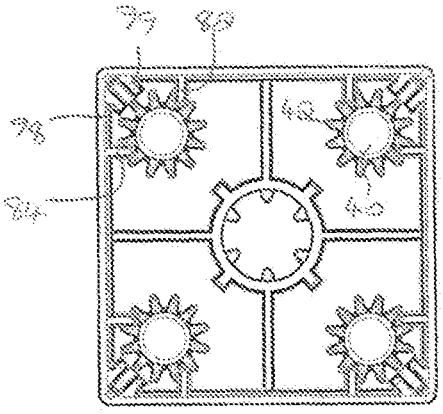
Figure 47:
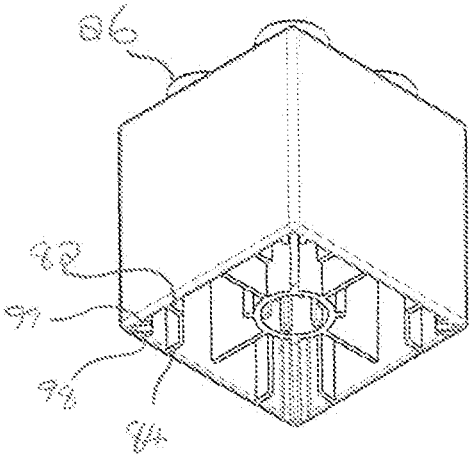
Figure 48:
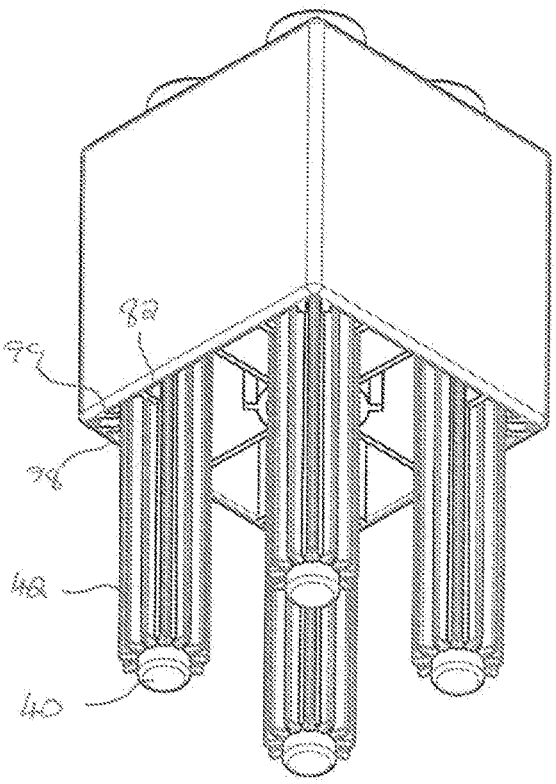
FIGS. 48 to 50 show different views of the brick and shaft assembly of FIG. 46.

In an alternative example shown in FIGS. 45 to 48 there are provided third and fourth engagement protrusions 98, 99 (of different configuration to the previously termed "third and fourth engagement protrusions") which extend from the inner surface of opposite sides of the corner of the brick element. That is to say, the third and fourth engagement protrusions 98, 99 extend from the inner surface of different walls on opposite sides of the corner. The third and fourth engagement protrusions 98, 99 may be provided as thin walled structures. The third and fourth engagement protrusions 98, 99 of this example are spaced apart from one another, each terminating in a free end 86. The third and fourth engagement protrusions 98, 99 are spaced apart from, and located between, the first and second engagement protrusions 82, 84. The third and fourth engagement protrusion free ends 86 are spaced apart from one another to define a passage 97 for engagement with, or to receive, or capture, or align with an end of the spline 42 of the shaft element member 40, as shown in FIGS. 46, 48. In this example, the engagement protrusions free ends 86 are spaced apart from one another such that they are configured to receive, and engage with, the male engagement feature 20 (e.g. stud 26) of another brick element.

In all examples, as shown in the figures, engagement protrusions may be provided in each corner of the brick elements of the present disclosure.

Figure 49:
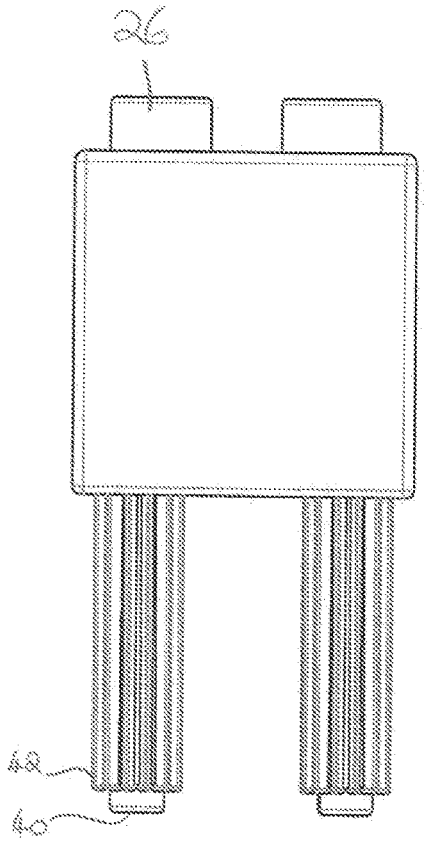
Figure 50:
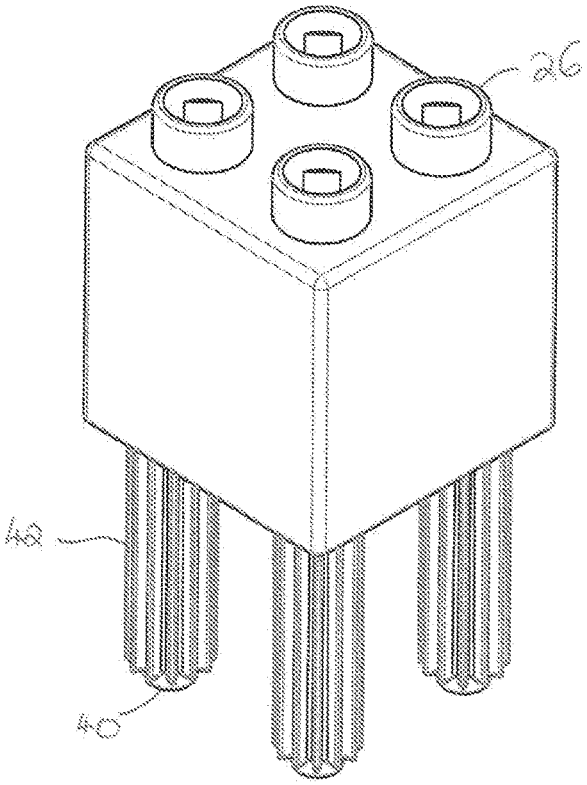

FIGS. 49, 50 show how the shaft element 40 may be built into the brick element for any of the examples bricks of the present disclosure, for example a shaft may be entered and held in some or all of the corners of the brick elements.

Figure 51:
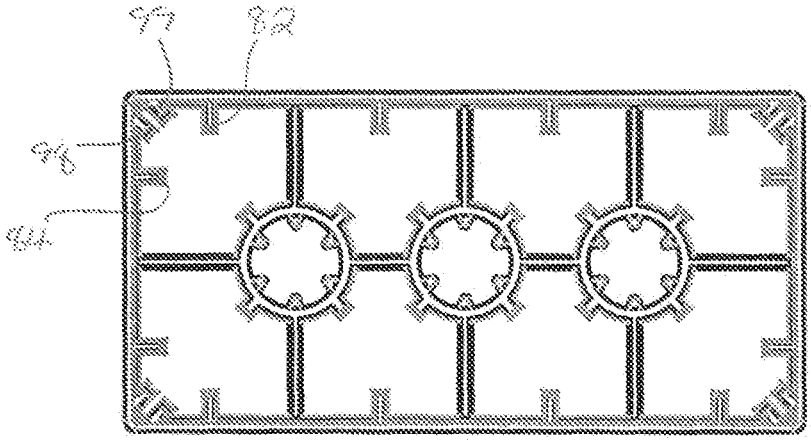
FIGS. 51 to 53 show a ninth example of brick element according to the present disclosure.
Figure 52:
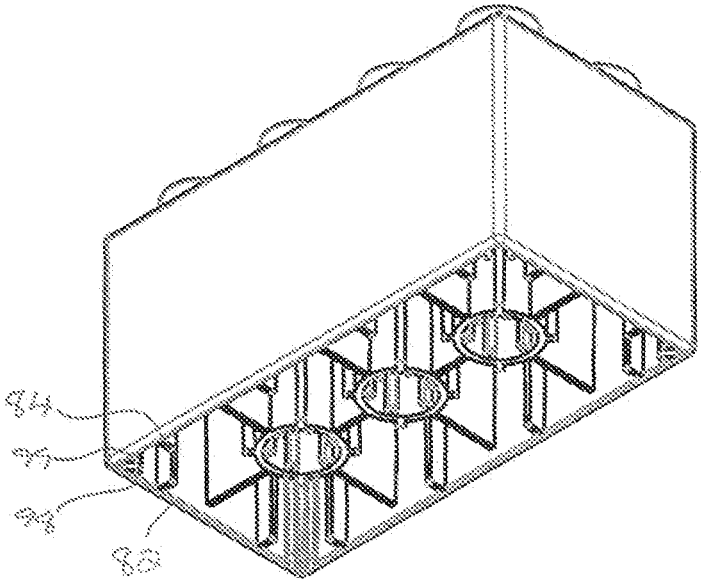
Figure 53:
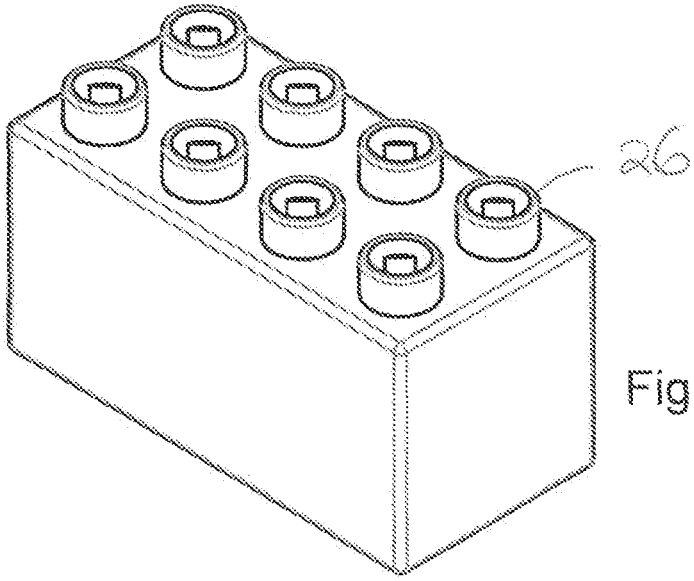

FIGS. 51 to 53 show an example of a different cuboid brick element, according to the present disclosure, which is essentially the same as the cubic brick element, and may be joined to the cubic brick elements and triangular brick elements in the same way as the cubic and triangular brick elements are joined. It differs in that it is rectangular in shape so that it has square ends walls, rectangular side walls and top, as well as a rectangular shaped cavity opening which defines its female mating side. Although it is shown in FIGS. 51 to 53 with engagement protrusions of the same configuration as the cubic brick elements of FIGS. 45 to 47, it may alternatively be provided with engagement protrusions of any of the other examples of the present disclosure.

Since the male and female mating sides and engagement features of the various examples of triangular prism shaped bricks and cubic bricks are complementary in size and shape, the female mating side and male mating side of any triangular prism shaped brick or cubic brick may be joined to a complementary side of any other triangular prism shaped brick or cuboid brick of the present disclosure.

Figure 54:
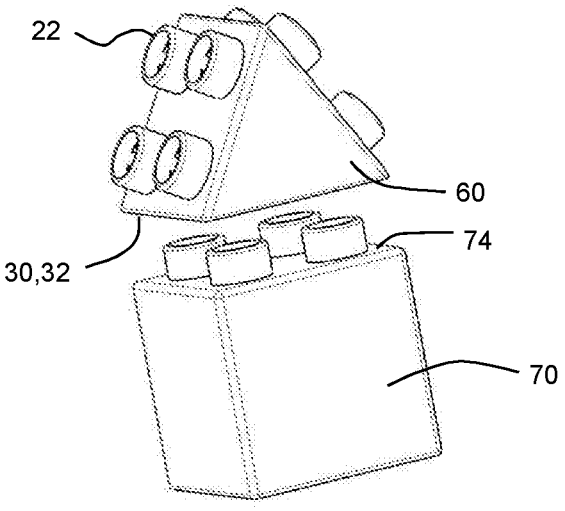
FIGS. 54 to 65 show examples of assembly structures of bricks of the present disclosure.
Figure 55:
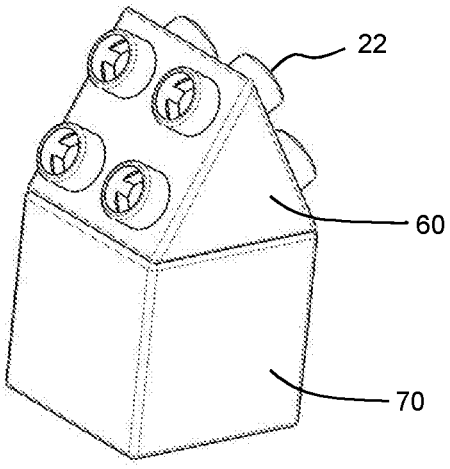

For example, as shown in FIGS. 54, 55, a triangular prism shaped brick 70 may have its female mating side 30 engaged with a male mating side 74 of a cubic brick 74. Thus provided they are aligned correctly, the shape shown in FIG. 55 may be constructed. Since the male engagement features (i.e. studs 22) and female engagement feature (i.e. features of the cavity 32 defined by the walls of the brick etc, as described previously) are sized, shaped and configured to frictionally engage with one another, when they are brought together only a small amount of force is required to bring them into engagement. The bricks will stay together until a small amount of force is used to pull the bricks apart. The amount of force required is predetermined, having a value in the range achievable by a child.

As described above, the shaft member element 40 is configured to be received by the tubes 36, 78 of the brick elements. In one example, the shaft member element 40 has a predetermined length such that the shaft may be entered in the tubes of two brick elements to join the brick elements. It has a length which enables the female mating side 72 of one of the brick elements to be brought into contact with the female mating side 72 of the other brick element.

Figure 56:
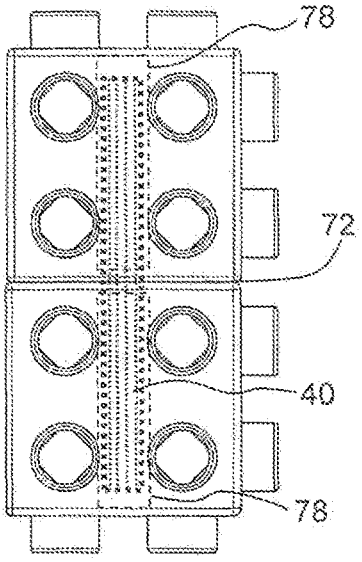

Hence, as shown in FIG. 56, a shaft member element 40 for joining two cubic brick elements may have a predetermined length no more than twice the length of the edge of the male and/or female mating sides of the cubic brick element. More specifically its predetermined length may be in the range of 90% to 99% of twice the length of the edge of a male and/or female mating side. The tubes 78 and shaft 40, being internal features, are shown as dotted lines. The same convention is used in the remaining figures.

Figure 57:
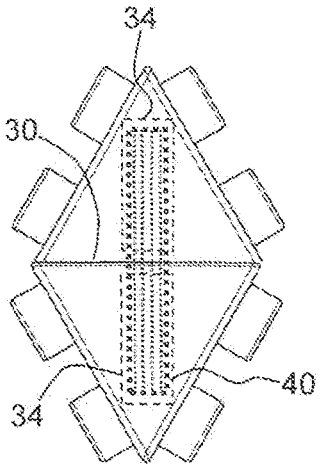

Alternatively, as shown in FIG. 57, a shaft member 40 may be provided so that the shaft may be entered in the tubes 34 of two triangular prism brick elements to join the brick elements, and has a predetermined length which enables the female mating side 30 of one of the triangular brick elements to be brought into contact with the female mating side 30 of the other triangular brick elements. The shaft 40 of this example has a different length to the shaft of the FIG. 56 example.

Figure 58:
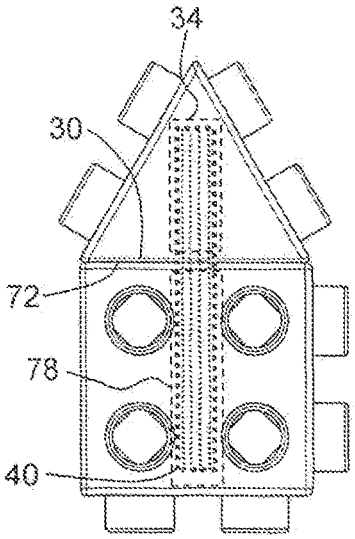
Figure 59:
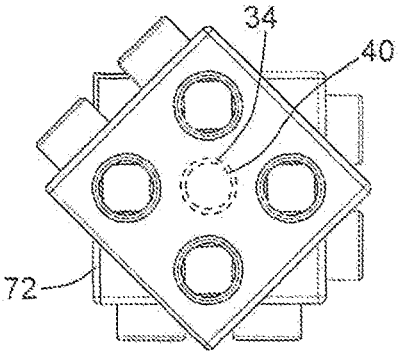

In another example, as shown in FIG. 58 a shaft member 40 may be provided so that the shaft may be entered in the tube 34 of a triangular prism brick element and a tube 78 of a cubic brick element to join the brick elements, and has a predetermined length which enables the female mating side 30 of the triangular brick element to be brought into contact with the female mating side 72 of the cubic brick element.

The provision of the shaft 40 allows for the joined bricks to be rotatable relative to one another around the longitudinal axis of the shaft 40. That is to say, the sides of the brick elements may be aligned (as shown in FIG. 56, 57, 58) or the sides of the bricks may be at a range of angles to one another (one example of which is shown in FIG. 40, which is a plan view of the arrangement of FIG. 56 with the top brick rotated relative to the bottom brick about the shaft 40).

In examples where the shaft 40 and tubes 34, 78 are splined (as described in previous examples) then this provides for control of the rotation of one brick element relative to the other about the longitudinal axis of the shaft 40. In such an example, where the shaft 40 is as shown in FIGS. 6, 7, and has twelve splines, then this allows for the brick elements to be rotated relative to one another about the longitudinal axis of the shaft 40 in 30 degree increments.

Figure 60:
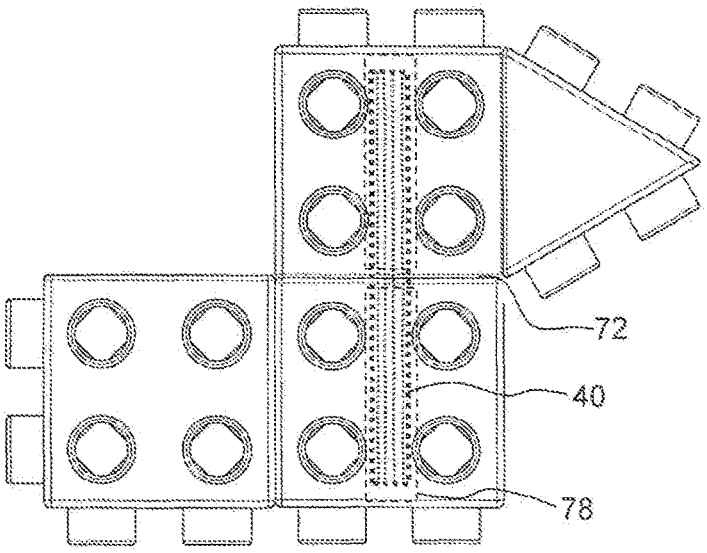

This arrangement also allows for other brick elements to be added to the sides of the shaft-joined elements, as shown in FIG. 60, allowing the build to extend in a direction away from the longitudinal axis of the shaft 40.

Figure 61:
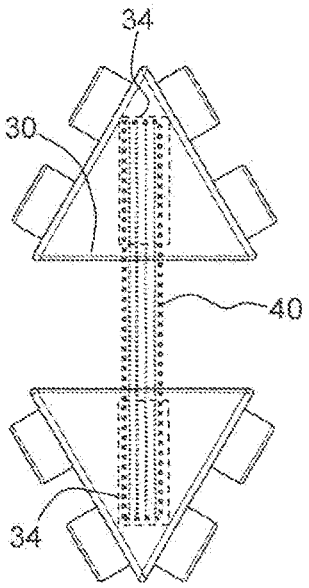
Figure 62:
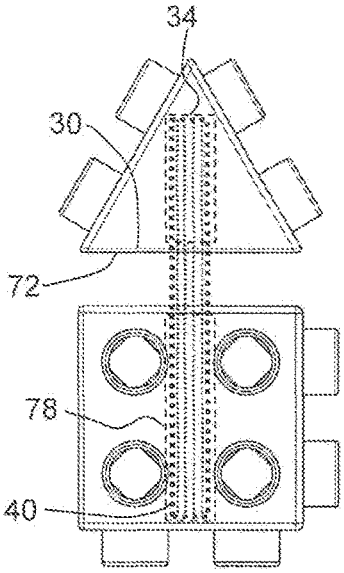

In other examples triangular prism brick elements may to be joined back to back with a shaft element member 40 (see FIG. 61) or for triangular prism elements to be joined back to back with a cubic brick element with a shaft element member 40 (see FIG. 62). The elements may be aligned or angled relative to one another around the axis of the shaft member which joins them. The shaft splines and brick engagement features allow for fixing the relative angles and positions of the brick elements.

Figure 63:
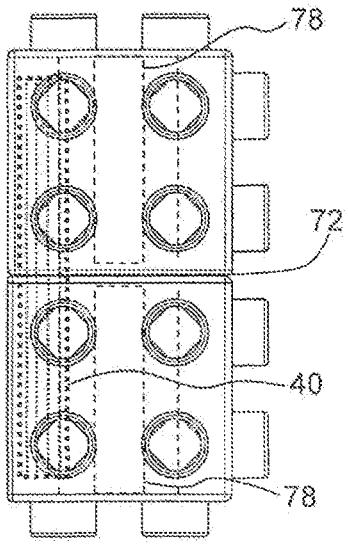

As shown in FIG. 63, cubic brick elements may be joined back to back with a shaft element 40 extending into the corner engagement protrusions (for example as discussed in FIGS. 36 to 47) such that the brick female mating sides are closed.

Figure 64:
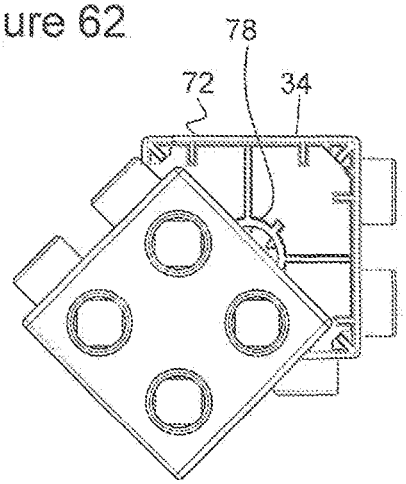

Alternatively, as shown in FIG. 64, cubic brick elements may be joined back to back with a shaft element 40 extending into the engagement protrusions of one corner of both brick elements (for example as discussed in FIGS. 36 to 47) such that the bricks are angled relative to one another, and only partially close the female mating sides.

Figure 65:
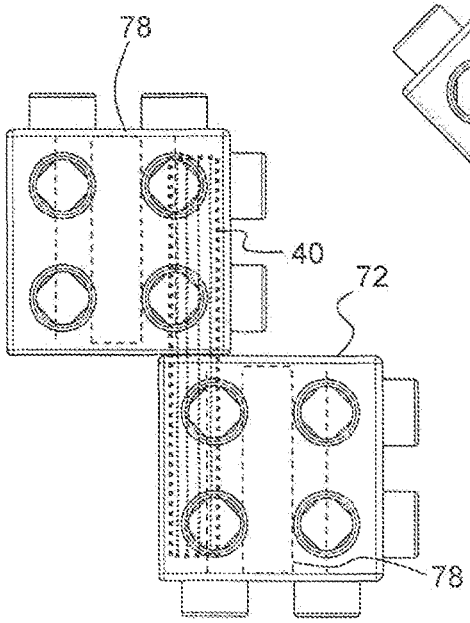

In another example, as shown in FIG. 65, cubic brick elements may be joined back to back with a shaft element 40 extending into the engagement protrusions of one or two corners such that the bricks are offset from one another, and only partially close the female mating sides.

Figure 66:
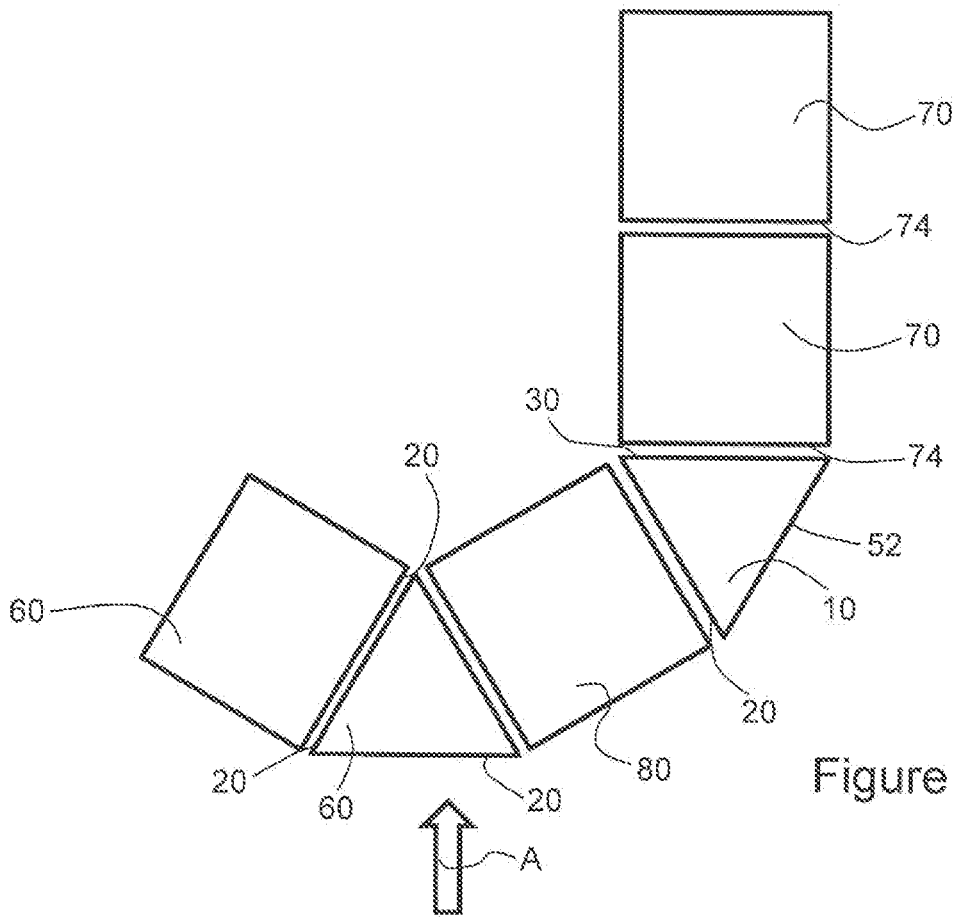
FIGS. 66, 67 show different views of an assembly of constructional elements according to the present disclosure.
Figure 67:
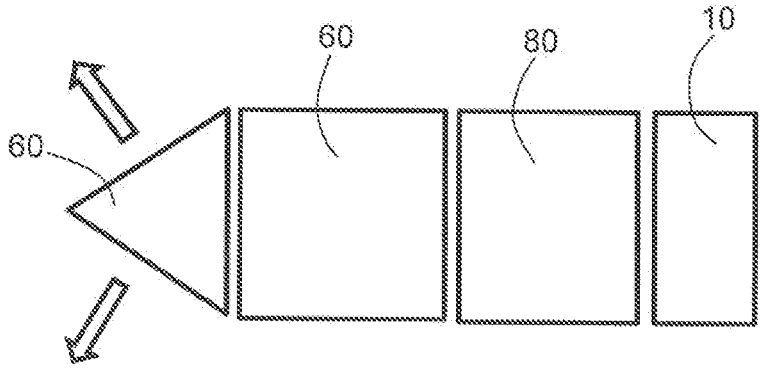

A further example of an assembly of the triangular prism shaped bricks and cubic bricks is shown in FIGS. 66 and 67. The assembly shown in FIG. 66 is viewed from above, and view shown in FIG. 67 is a side view as viewed in the directional of arrow "A" in FIG. 66.

In FIGS. 66, 67 details of the engagement features of the bricks are omitted for clarity, hence the studs which form the male engagement feature, the tube which extends from the wall of each brick, and details of the female engagement feature are not shown. Gaps are shown between the brick elements, although it will be appreciated in reality that no such gaps need be present. The gaps in the representation in FIGS. 66 and 67 are merely to help delineate the edges of the individual brick elements.

In this example, and starting from the top of the figure, as shown on the page, a male engagement feature 74 of a first cubic brick 70 is joined to female engagement feature 72 of a second cubic brick 70. The second cubic element 70 is joined via its male engagement feature 74 to a female engagement feature 30 of a triangular prism shaped brick 10. The male engagement feature 20 of the triangular prism shaped brick 10 is engaged with a female engagement feature of another cubic brick 80, leaving the planar side 52 of the triangular prism shaped brick 10 to form part of the exterior curve of the shape. The brick 80 is likewise joined to a further triangular brick 60 and another triangular prism shaped brick 60 is attached thereto.

Hence, a "J" shape with a pointed end may be formed. From this the structure may extend away in any direction from which studs extend or female engagement mating sides are exposed.

Figure 68:
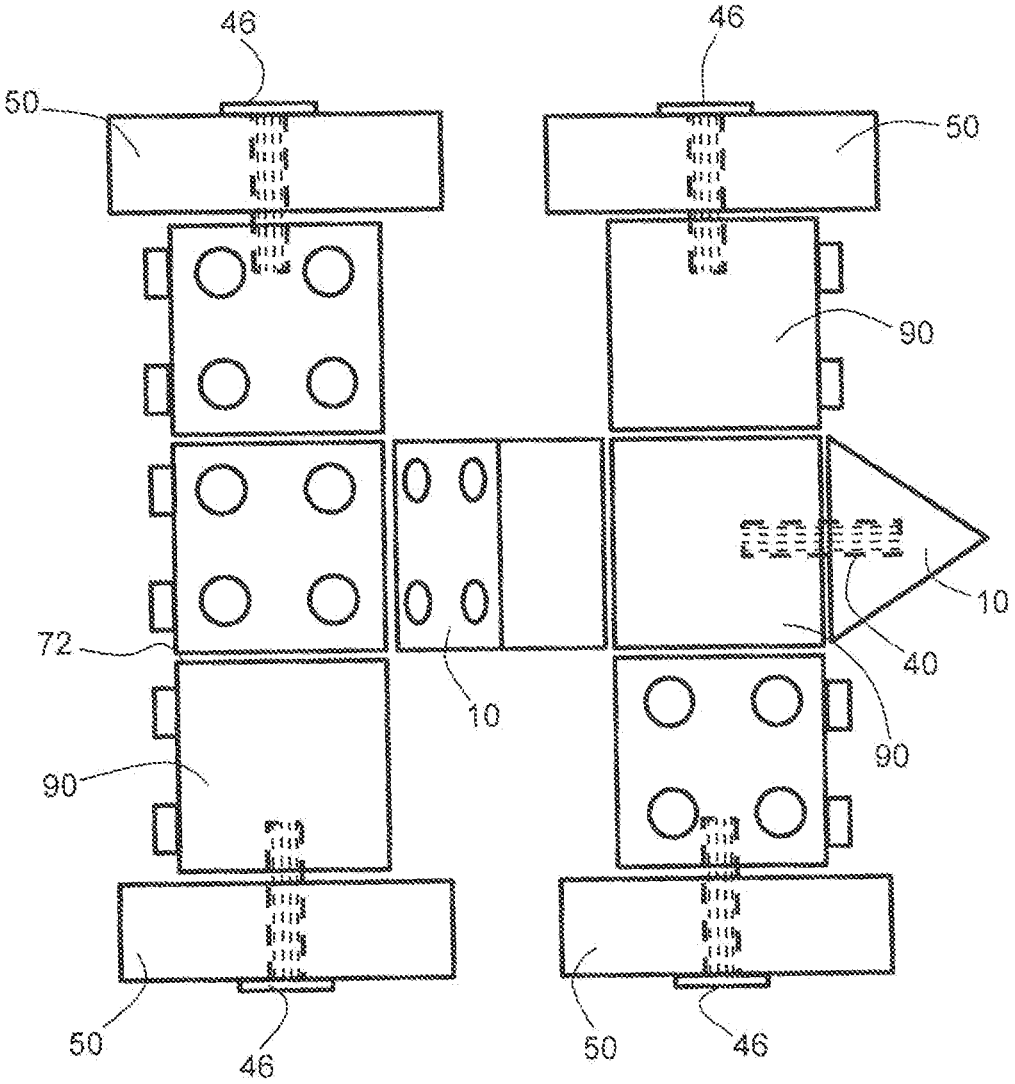
FIG. 68 shows a further example of an assembly of brick elements according to the constructional toy of the present disclosure.

Further structures may be developed using the triangular prism shaped bricks and cubic bricks and the additional pieces shown in FIGS. 6 to 9, namely the shafts and wheels. An example is shown in FIG. 68. This structure comprises a collection of cubic bricks having configurations as previously described, where joins between the bricks are shown with a slight spacing to delineate interfaces between the bricks. The precise nature of the build is not important from the point of view of the constructional toy of the present disclosure, and is shown only as an example. Suffice it to say that where joins are shown male engagement features are engaged with female engagement features. Where the wheels 50 are attached to bricks, this is done using shafts 46 which extend through the centre of wheels, into tubes 78 of the cubic bricks. Likewise at the right hand side, where a triangular prism shaped brick is attached to a cubic brick, this is done using a shaft 40 which extends into the tube passage of both the cubic brick and the triangular shaped prism brick. The central triangular prism brick 10 shown in the figure is mounted on top of a cubic brick which joins the bricks to either side of it.

Hence, it can be seen that a complex structure can be easily built, which is satisfying and entertaining for a child to generate.

Of course many combinations may be developed, each of which enable a user to explore the different features of the brick system of the present disclosure. Each configuration allows the user to appreciate different mechanical issues, as well as exploring the concepts of form and aesthetics.

Hence there is provided a constructional toy comprising a plurality of elements which can be assembled together to form a variety of three dimensional structures.

A plurality of configurations may be built and experimented with by a user. The flexibility of the system allows for unstructured creative play as well as directed educational sessions to thereby support a child's learning about the best and the worst ways of configuring structures, setting a foundation for more advanced learning.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A constructional toy comprising a plurality of elements which can be assembled together to form a variety of three dimensional structures, said elements including:

a triangular prism shaped brick element comprising a plurality of walls which define:

two square sides angled relative to one another, at least one of which is provided as a male mating side having a male engagement feature which extends from the brick element; and a cavity which provides a female mating side, the cavity defined by the plurality of walls, at least one of the square wall sides having an indented region extending into its inner surface;

the cavity having a square perimeter defined by an edge of each wall, wherein the cavity is configured with a female engagement feature of the same configuration as provided on the male mating side, and the indented region is positioned and configured to receive a portion of the engagement feature; the male mating side comprises:

a planar wall which defines a side of the brick, from which extends a stud to provide a male engagement feature;

a stud is provided substantially towards each corner of the male mating side; and a tube that extends from one or more of the walls of the brick, open on the female mating side, for receiving a shaft member element to thereby link brick elements of the constructional toy together.

2. The constructional toy as claimed in claim 1 wherein the tube defines a through passage from the external surface of the wall of the brick from which it extends.

3. The constructional toy as claimed in claim 2 wherein the tube is closed at the end where it extends from the wall of the brick.

4. The constructional toy as claimed in claim 1, wherein the tube extends from a plane walled side of a cuboid brick element.

5. The A constructional toy as claimed in claim 1, wherein splines extend radially inwards from the internal surface of the tube part way across the width of the tube.

6. The A constructional toy as claimed in claim 1, wherein a stud is provided substantially towards each corner of the male mating side and wherein the tube is provided substantially equidistant from each of the studs.

7. The constructional toy as claimed claim 1, further comprising:

a shaft member element comprising splines which extend radially outwards along the length of the shaft.

8. The constructional toy as claimed in claim 7, wherein the female mating side further comprises a tube that extends from one or more of the walls of the brick, open on the female mating side, for receiving a shaft member element wherein the shaft is configured to be received by the tube.

9. The constructional toy as claimed in claim 7 wherein:

a pair of first and second engagement protrusions are provided in a corner region of the brick element where the brick element walls meet to form a corner of the female mating side of the brick element;

each of the first and second engagement protrusions extend from the inner surface of a different wall, and extend from a position spaced apart from the corner of the brick element;

each of the first and second engagement protrusions terminate in a free end, the engagement protrusion free ends being spaced apart from one another and configured to receive, and to be engageable with, splines of the shaft member element.

10. The constructional toy as claimed in claim 9 wherein:

the first and second engagement protrusions are each configured to, at least in part, fit between adjacent shaft member element splines, to thereby engage with and retain the shaft member element.

11. The constructional toy as claimed in claim 9, wherein one of the pair of first and second engagement protrusions extends from the indented region.

12. The constructional toy as claimed in claim 9, wherein a third engagement protrusion extends from the inner surface of the brick element corner and terminates in a free end, the third engagement protrusion being spaced apart from, and located between, the first and second engagement protrusions, the first, second and third engagement protrusion free ends being spaced apart from one another such that the third engagement protrusion is configured to face the end of a spline of the shaft member element.

13. The constructional toy as claimed in claim 12, wherein the third engagement protrusion comprises a support section which extends from the brick element corner, and a flat end section which defines the free end of the support section, wherein the flat end section extends to either side support section, such that the third engagement protrusion is "T" shaped.

14. The constructional toy as claimed in claim 12, wherein a fourth engagement protrusion and fifth engagement protrusion are provided to either side of the third engagement protrusion the fourth engagement protrusion being spaced apart from, and located between, the first and third engagement protrusions, the fifth engagement protrusion being spaced apart from, and located between, the second and third engagement protrusions, each of the fourth engagement protrusion and fifth engagement protrusion terminating in a free end, the first, second, third, fourth and fifth engagement protrusions free ends being spaced apart from one another.

15. The constructional toy as claimed in claim 9, wherein third and fourth engagement protrusions extend from the inner surface of different walls on opposite sides of the corner;

the third and fourth engagement protrusions being spaced apart from one another, each terminating in a free end, the third and fourth engagement protrusions being spaced apart from, and located between, the first and second engagement protrusions, the third and fourth engagement protrusion free ends being spaced apart from one another to define a gap therebetween.

* * * * *